US006263842B1

(12) United States Patent
De Ojeda et al.

(10) Patent No.: US 6,263,842 B1
(45) Date of Patent: Jul. 24, 2001

(54) HYDRAULICALLY-ASSISTED ENGINE VALVE ACTUATOR

(75) Inventors: William De Ojeda, Chicago; Pranab K. Das, Naperville, both of IL (US)

(73) Assignee: International Truck and Engine Corporation, Chicago, IL (US)

( * ) Notice: Subject to any disclaimer, the term of this patent is extended or adjusted under 35 U.S.C. 154(b) by 0 days.

(21) Appl. No.: 09/517,144

(22) Filed: Mar. 2, 2000

Related U.S. Application Data

(63) Continuation-in-part of application No. 09/152,497, filed on Sep. 9, 1998, now Pat. No. 6,044,815.
(60) Provisional application No. 60/172,984, filed on Dec. 20, 1999.

(51) Int. Cl.[7] ..... F01L 9/02
(52) U.S. Cl. ..... 123/90.12; 123/90.11; 251/30.01
(58) Field of Search ..... 123/90.11, 90.12, 123/90.13, 90.15, 90.46, 90.55, 90.63, 322; 251/30.01, 30.02, 30.03, 30.04, 30.05

(56) References Cited

U.S. PATENT DOCUMENTS

| | | | | |
|---|---|---|---|---|
| Re. 35,303 | | 7/1996 | Miller et al. . | |
| 4,200,067 | * | 4/1980 | Trenne | 123/90.12 |
| 4,206,728 | * | 6/1980 | Trenne | 123/90.12 |
| 4,476,823 | * | 10/1984 | Williams | 123/90.12 |
| 5,012,778 | | 5/1991 | Pitzi . | |
| 5,191,867 | | 3/1993 | Glassey . | |
| 5,224,683 | | 7/1993 | Richeson . | |
| 5,231,959 | * | 8/1993 | Smietana | 123/90.12 |
| 5,248,123 | | 9/1993 | Richeson et al. . | |
| 5,287,829 | | 2/1994 | Rose . | |
| 5,335,633 | * | 8/1994 | Thien | 123/90.12 |
| 5,339,777 | | 8/1994 | Cannon . | |
| 5,392,749 | | 2/1995 | Stockner . | |
| 5,410,994 | | 5/1995 | Schechter . | |
| 5,419,301 | | 5/1995 | Schecheter . | |
| 5,421,359 | | 6/1995 | Meister et al. . | |
| 5,448,973 | | 9/1995 | Meyer . | |
| 5,456,221 | | 10/1995 | Schechter . | |
| 5,456,222 | | 10/1995 | Schechter . | |
| 5,456,223 | | 10/1995 | Miller et al. . | |
| 5,509,637 | * | 4/1996 | Leonard | 123/90.12 |
| 5,529,030 | | 6/1996 | Rose . | |
| 5,542,382 | * | 8/1996 | Clarke | 123/90.12 |
| 5,582,141 | * | 12/1996 | Meyer | 123/90.12 |
| 5,595,148 | | 1/1997 | Letsche et al. . | |
| 5,619,965 | * | 4/1997 | Cosma et al. | 123/322 |
| 5,636,602 | | 6/1997 | Meister . | |
| 5,683,781 | | 11/1997 | Sturman . | |
| 5,713,916 | * | 2/1998 | Sturman | 123/90.12 |
| 5,960,753 | * | 10/1999 | Sturman | 123/90.12 |
| 5,970,956 | | 10/1999 | Sturman . | |
| 6,135,073 | * | 10/2000 | Feucht et al. | 123/90.12 |

* cited by examiner

*Primary Examiner*—Teresa Walberg
*Assistant Examiner*—Fadi H. Dahbour
(74) *Attorney, Agent, or Firm*—Dennis Kelly Sullivan; Jeffrey P. Calfa; Gilberto Hernadez

(57) ABSTRACT

A hydraulically-assisted engine valve actuator for assisting in the actuation of an engine valve, includes a servo piston being operably coupled to the engine valve. A translatable pilot valve is in fluid communication with the servo piston and the main piston and is operably coupled to and controlled by a pilot valve positioning system. The pilot valve positioning system controls a translational stroke of the pilot valve to meter hydraulic fluid under pressure to and from the servo piston. A stroke magnifier magnifies a stroke of the pilot valve positioning system.

57 Claims, 20 Drawing Sheets

FIG. 2
OPEN STROKE
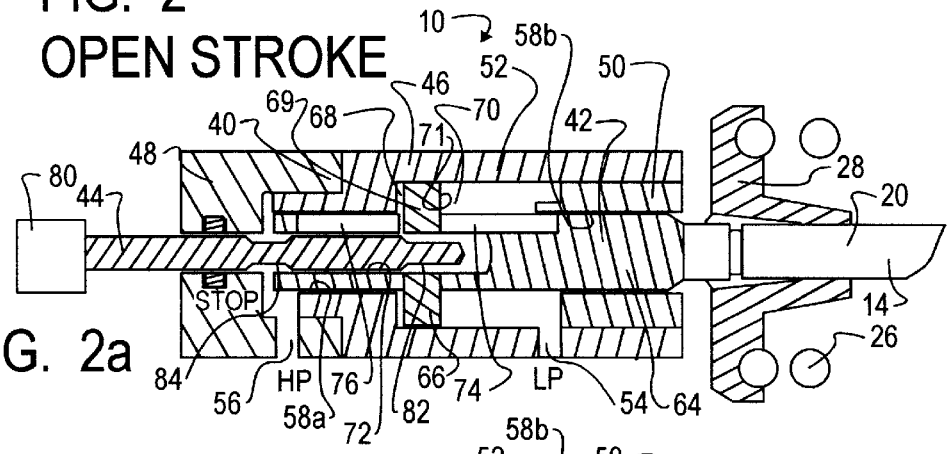
FIG. 2a
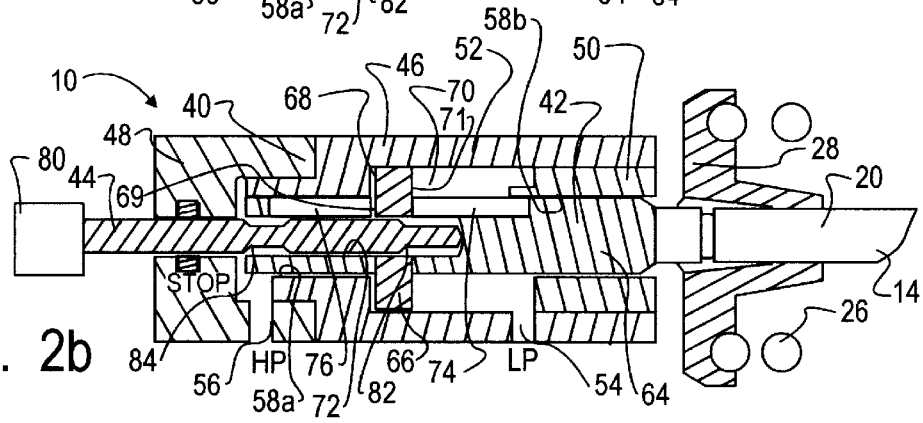
FIG. 2b
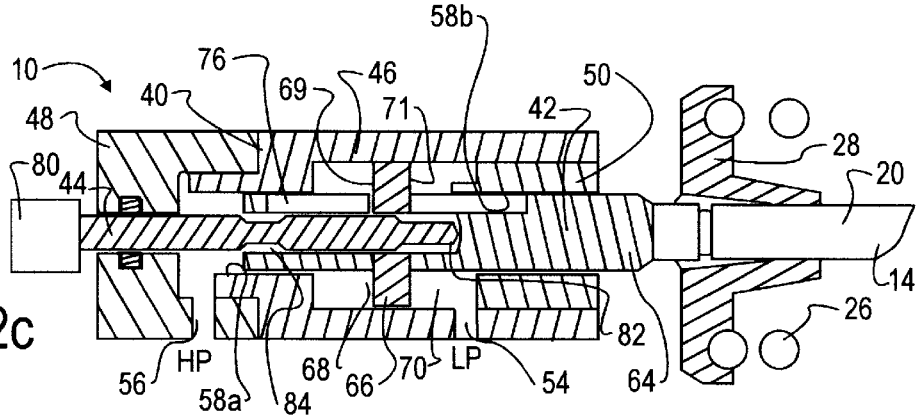
FIG. 2c
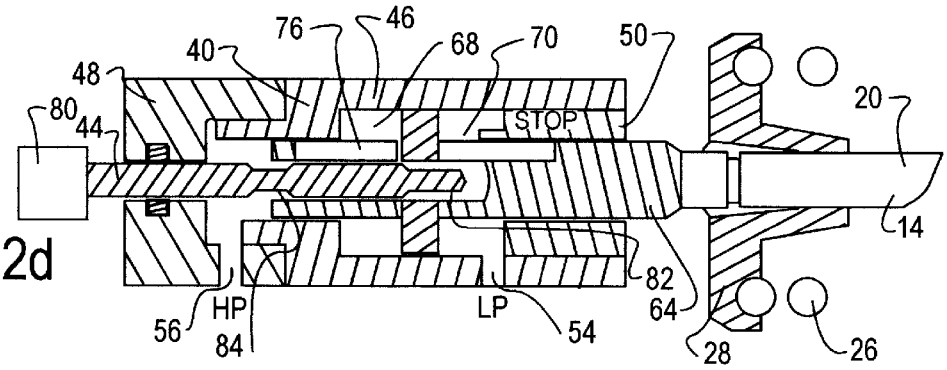
FIG. 2d FIG. 3
CLOSE STROKE
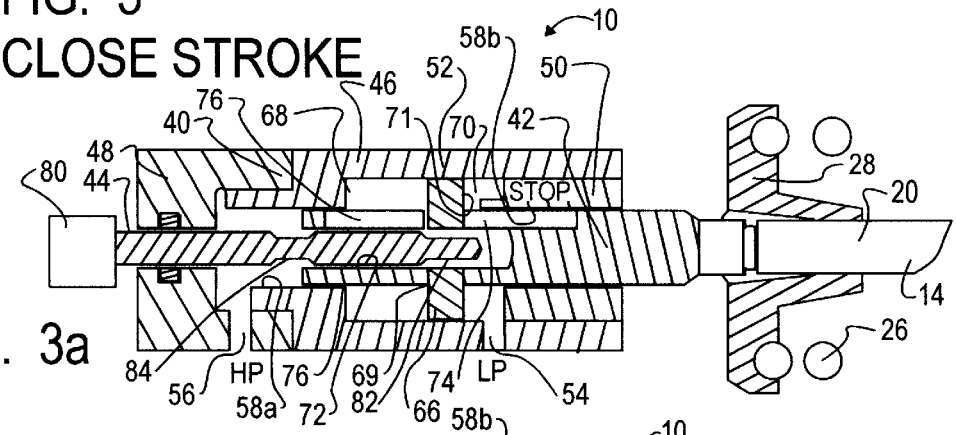
FIG. 3a
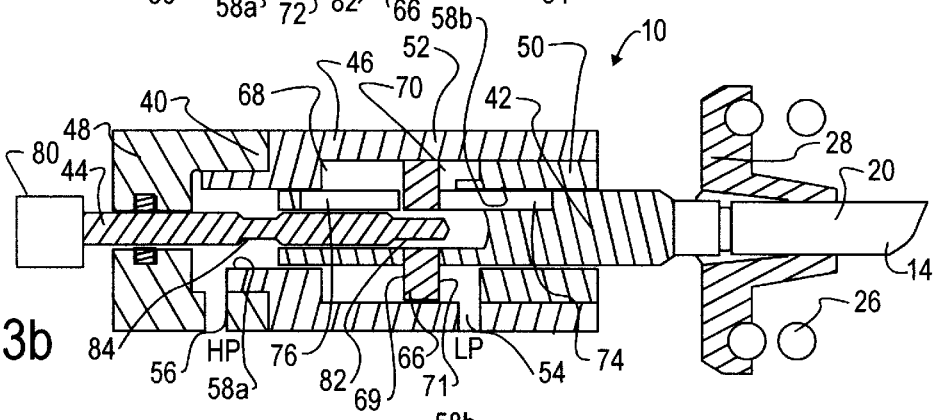
FIG. 3b
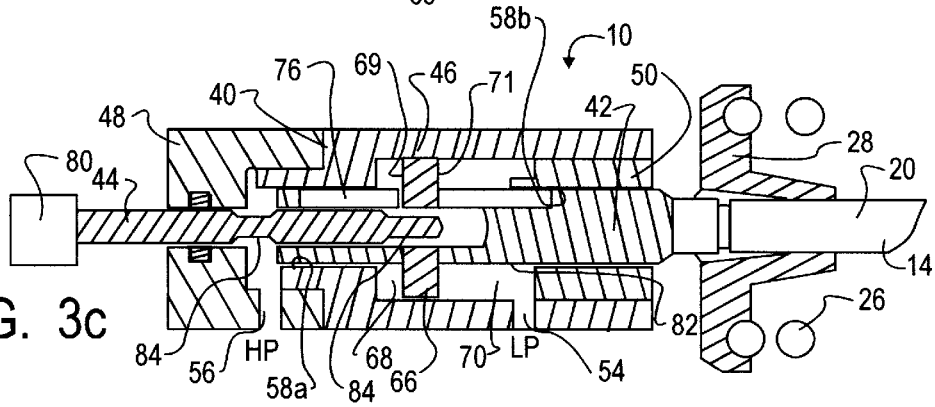
FIG. 3c
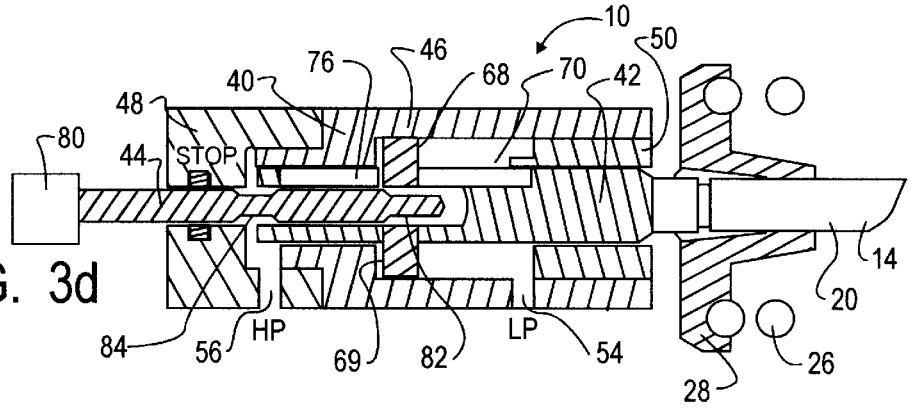
FIG. 3d

ENGINE VALVE IN CLOSED POSITION

OPEN STROKE

CLOSED STROKE

LASH ADJUSTMENT

HYDRAULICALLY-ASSISTED ENGINE VALVE ACTUATOR

RELATED APPLICATIONS

The present application is a continuation-in-part application of U.S. patent application Ser. No. 09/152,497, filed Sep. 9, 1998, now U.S. Pat. No. 6,044,815,. The present application further claims the benefit of U.S. Provisional Application No. 60/172,984, filed Dec. 20 ,1999, and incorporated herein in its entirety by reference.

TECHNICAL FIELD

The present invention relates to internal combustion engines. More particularly, the present invention relates to engine valve actuation.

BACKGROUND OF THE INVENTION

It is desirable that a hydraulically-assisted engine valve actuator provide for flexible engine valve operation under a wide band of engine operating conditions. The hydraulically-assisted engine valve actuator should provide for variable valve timing of closing and opening and variable lift as desired in order to achieve the greatest engine efficiencies. Presently, hydraulic fluid is supplied to hydraulically actuated valves through tubes commonly called rails. Valve motion profiles in current hydraulic actuation designs depend on a pre-established constant value of oil pressure at the supply rails because rail pressures cannot be adjusted fast enough to modulate valve profiles. The constant rail pressure values result in constant valve profiles regardless of engine rpm.

Present hydraulic actuation schemes add complexity to the engine design. Some hydraulic actuation designs rely on additional hydraulic supply rails at constant pressure levels. Further, hydraulic actuation that relies on on/off solenoid (spool or poppet) valve operations require engine valve position sensors for reliable timing of the solenoids and for safe operation. The plurality of sensors required, further adds to the engine complexity.

There is a need in providing such valve actuation to do so in as economical a manner as possible. A linear motor provides an excellent source of control actuation for the valve actuator. However, a linear motor is considerably more expensive than a solenoid. A solenoid should be used if its limitations can be accommodated.

The valve actuator should demonstrate simplicity of module. There should be no double dependencies in order to minimize the criticality of certain machining tolerances. The concentricity requirements of the device should be as lenient as possible.

The valve actuator should readily accommodate the extremes of valve lash that occur in a diesel cycle engine. Within several minutes after starting a cold engine, it is not uncommon for a valve to grow 0.020 inch due to increased valve temperature. It is helpful if the valve control module be not directly coupled to the engine valve so that no complexities need be designed into the control module to account for valve lash.

SUMMARY OF THE INVENTION

The hydraulically-assisted engine valve actuator of the present invention allows for flexible engine valve operation: variable valve timing of the closing and the opening and variable valve lift. Further, the mechanical components needed to effect the hydraulic actuation are relatively simple, thereby minimizing the additional engine components required. No sensors or mechanical damping mechanisms are needed. Additionally, the hydraulic actuation of the present invention is designed to provide for uniform actuation over a wide range of hydraulic fluid temperatures and viscosities.

The foregoing advantages of the present invention are effected by the use of fine needle control. The fine needle control provides for modulation of engine valve profiles: varying engine profiles at varying engine speeds, varying the shape of the profiles at a given rpm. The present invention further allows aggressive valve openings and closings which translates into better volumetric efficiency of the engine.

The hydraulically-assisted engine valve actuator of the present invention is not sensitive to pressure variation in the high-pressure rail, that is, the modulation of engine valve motion is capable of tolerating a substantial variation of pressure (above a predetermined threshold pressure) in the high-pressure rail.

The device of the present invention only requires one high-pressure supply line. The low-pressure line in an embodiment of the present invention is shared with the existing lubricating oil supply already available. In the case of engines with a fuel injection system incorporating a high-pressure rail for fuel injector actuation, the same high-pressure fluid supply is used for valve actuation in order to further minimize the added components to the engine.

In the case of the present invention, the output, i.e. the engine valve position, very closely follows the input to the hydraulic actuator. Therefore, the device of the present invention does not require the added complexity of requiring a sensor to measure engine valve position for feedback control. Accurate control of valve seating is attained by accurate control of the needle at the end of the stroke.

The present invention further provides very good cold temperature operating performance despite the hydraulic actuating fluid preferably being lubricating oil. The proportional flow areas of the hydraulic fluid passages are not so small as to compromise performance under variable operating temperatures. This is especially important in cold temperature operation since the viscosity of hydraulic fluid, particularly lubricating oil, is significantly higher when the engine is cold than after the engine has warmed up.

In an embodiment, the present invention incorporates a needle and main piston that are decoupled from the engine valve. A secondary piston is coupled to the engine valve for providing actuation of the engine valve. The hydraulic coupling between the secondary piston and the main piston is automatically adjusted to accommodate engine lash. Additionally, the stroke of the main piston acts as a stroke length magnifier, permitting the use of a solenoid controller. The linear stroke of a solenoid is limited to about 4 mm. A typical engine valve requires an opening stroke of about 12 mm. In an embodiment, a 3:1 ratio between the main piston and the secondary piston provides for an effective three times increase in the stroke of the solenoid to effect the full opening stroke of the engine valve.

Further, the mechanical components that are required for valve actuation by the present invention do not significantly increase the engine complexity, i.e., very few modifications to an existing cylinder head are needed in order to incorporate the valve actuator module of the present invention.

BRIEF DESCRIPTION OF THE DRAWINGS

FIGS. 2*a*–2*b* depict the valve opening cycle. Specifically, FIG. 2*a* is a side elevational view in section of the valve actuator with the actuator and the valve in the closed retracted configuration;

FIG. 2*b* is a side elevational view in section of the valve actuator with the actuator needle commencing translation to the right and the valve in the closed retracted configuration;

FIG. 2*c* is a side elevational view in section of the valve actuator with the actuator needle in a rightward position and the valve approaching the open extended configuration;

FIG. 2*d* is a side elevational view in section of the valve actuator with the actuator needle and valve stopped in the open extended configuration;

FIGS. 3*a*–3*b* depict the valve closing cycle. Specifically, FIG. 3*a* is a side elevational view in section of the valve actuator with the actuator needle and the valve in the open extended configuration;

FIG. 3*b* is a side elevational view in section of the valve actuator with the actuator needle and the valve in the open extended configuration, the actuator needle having translated to the left exposing the extender chamber to low pressure hydraulic fluid;

FIG. 3*c* is a side elevational view in section of the valve actuator with the valve in transition between the open extended configuration and the closed retracted configuration, the actuator needle having translated to the left exposing the extender chamber to low pressure hydraulic fluid;

FIG. 3*d* is a side elevational view in section of the valve actuator with the actuator needle and valve in the closed retracted configuration;

FIG. 4*a* is a graph of actuator and valve displacement over time;

FIG. 4*b* is a graph of the flow of high pressure hydraulic fluid to the actuator over time;

FIG. 5*a* is a side elevational view in section of the valve actuator with the actuator and valve in the closed retracted configuration just prior to the valve downstroke;

FIG. 5*b* is a side elevational view in section of the valve actuator with the actuator needle commencing translation to the downward and the valve in the closed retracted configuration;

DETAILED DESCRIPTION OF THE PREFERRED EMBODIMENT

Figure 1:
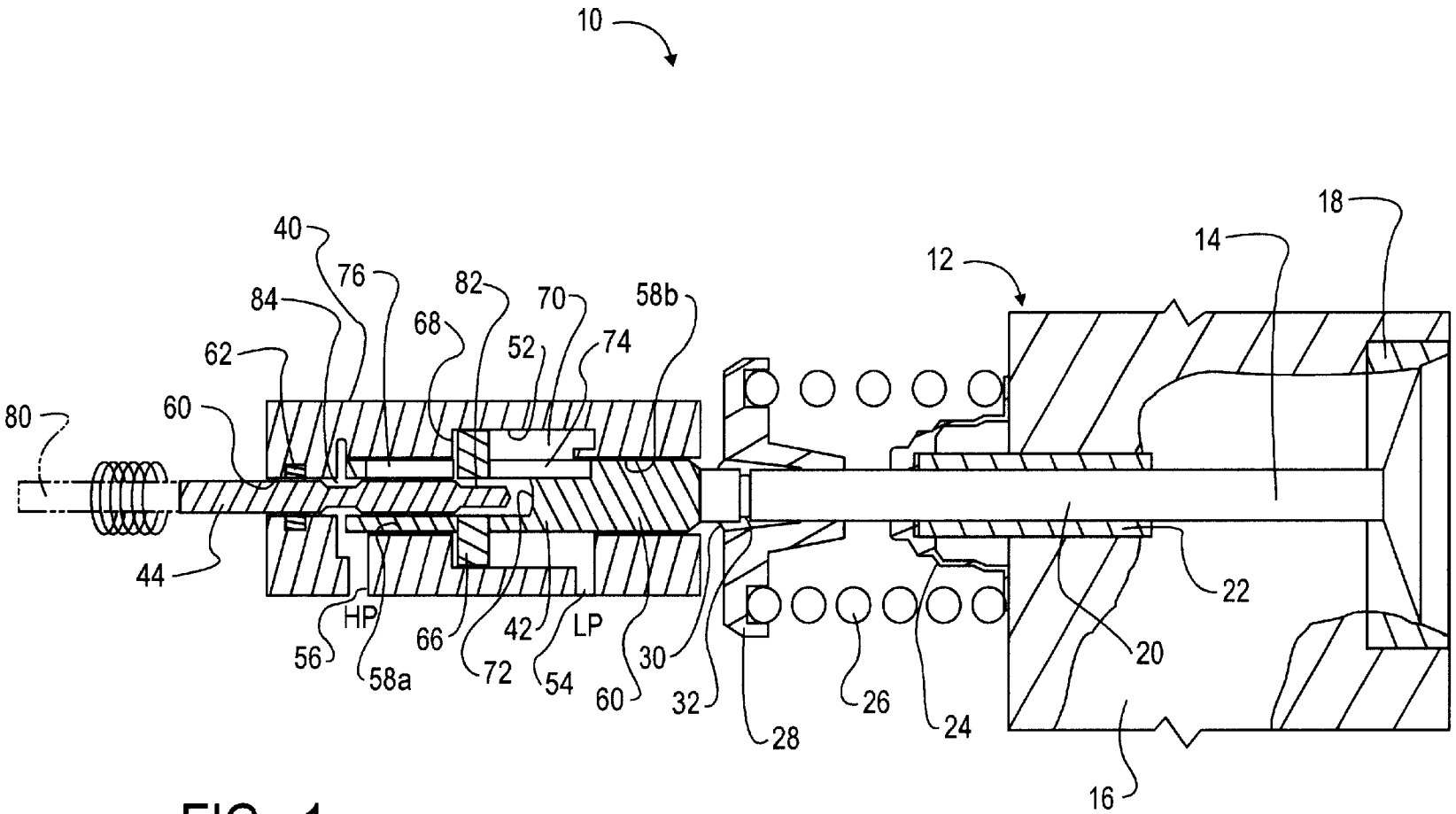
FIG. 1 is a side elevational view in section of the hydraulically-assisted engine valve actuator of the present invention coupled to an engine valve.
Figure 4:
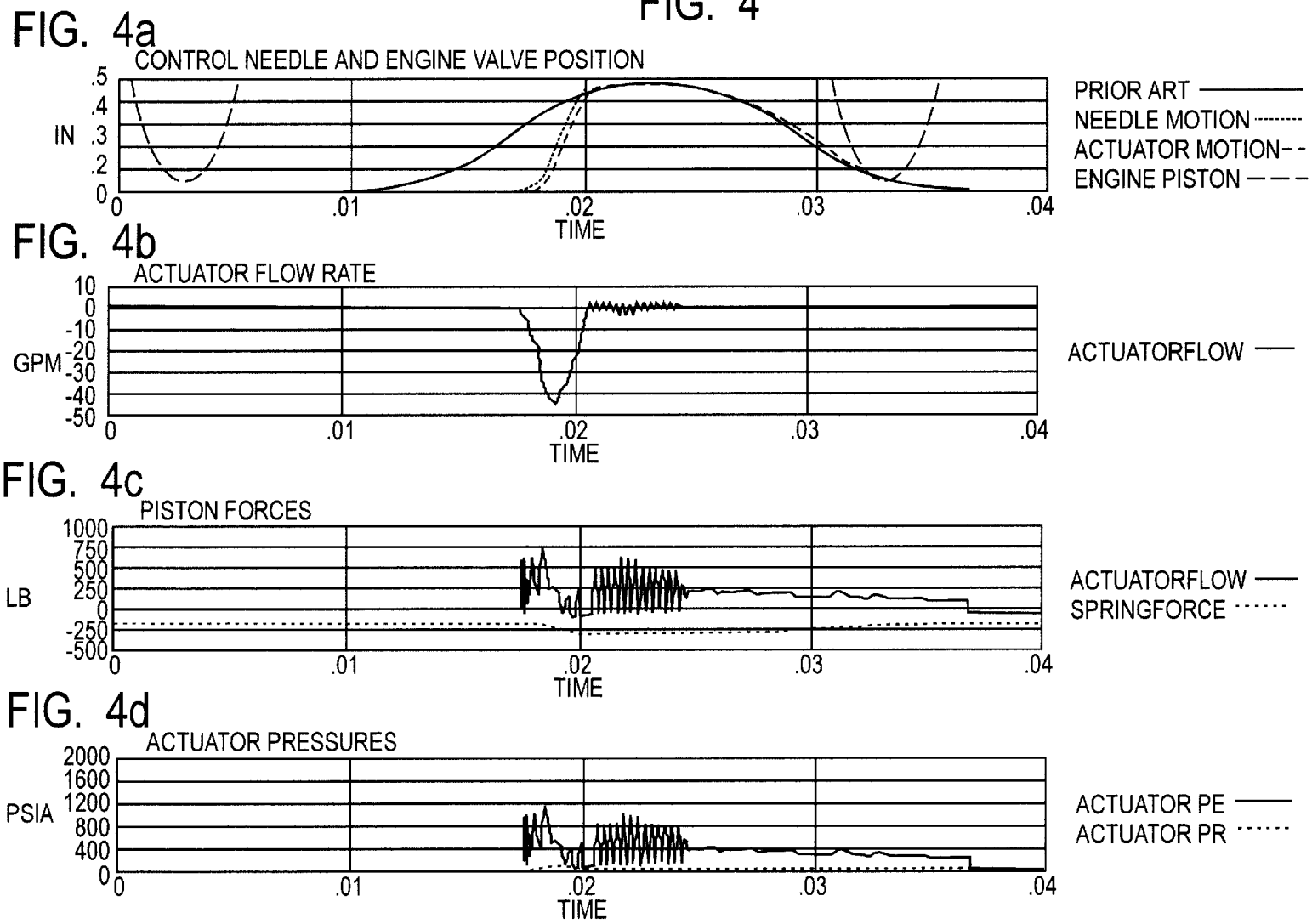
FIGS. 4*a*–4*b* depict various actuator and valve parameters on a common time base, the valve being actuated by the valve actuator of the present invention. Specifically.
FIG. 4*c* is a graph of force on the actuator piston and the valve spring force over time.
FIG. 4*d* is a graph of actuator pressure in the extender and retractor chambers over time.

The hydraulically assisted engine valve actuator of the present invention is shown generally at 10 in FIGS. 1–5*f*. In FIG. 1, actuator 10 is depicted coupled to an engine head 12.

The engine head 12 has a valve 14 translatably disposed therein. The valve 14 opens and closes an intake/exhaust passageway 16. Intake/exhaust passageway 16 is either an intake passageway or an exhaust passageway depending on whether the valve 14 is an intake valve or an exhaust valve. For the purposes of the present invention depicted in FIGS. 1–5*f*, valve 14 can be either an intake or an exhaust valve.

In the depiction of FIG. 1, valve 14 is in the closed configuration seated on valve seat 18. An elongate cylindrical valve stem 20 is translatably borne within a valve guide 22. A valve seal 24 mounted on the engine head 12 prevents fluids from escaping around the valve stem 20.

A coil valve spring 26 is disposed concentric with the valve stem 20 and has a first end bearing on the engine head 12. The second end of the valve spring 26 is retained within a valve rotator 28. The valve spring 26 is preferably maintained in a state of compression between the valve rotator 28 and the engine head 12 when the valve 14 is either in the open or closed configurations, compression of valve spring 26 being greatest when the valve 14 is open. A valve keeper 30 has a portion thereof disposed within a keeper groove 32 formed circumferential to the valve stem 20. The valve keeper 30 holds the valve rotator 28 in engagement with the valve stem 20.

The hydraulic actuator 10 of the present invention includes three major components: actuator casing 40, actuator piston 42, and needle 44.

Referring to FIG. 2*a*, the actuator casing 40 is preferably formed of three components: a centrally disposed casing body 46, a casing cap 48, and a casing insert 50. Referring again to FIG. 1, the casing body 46 of the actuator casing 40 has a cylinder bore 52 defined concentric with the longitudinal axis of the actuator casing 40. A low pressure (LP) fluid passageway 54 is defined between the casing body 46 and the casing insert 50. LP fluid passageway 54 extends from the is exterior of the actuator casing 40 to intersect the cylinder bore 52.

A piston bore 58*a*, 58*b* is defined concentric with the longitudinal axis of the actuator casing 40 and the casing body 46 and casing insert 50, respectively. The piston bore 58*a*, 58*b* is generally cylindrical, having a diameter that is substantially less than the diameter of the cylinder bore 52. A high pressure (HP) fluid passageway 56 is defined between the casing body 46 and the casing cap 48. HP fluid passageway 56 intersects the piston bore 58*a*.

A needle bore 60 is defined in the casing cap 48 of the actuator casing 40. An 0-ring seal groove 62 is defined circumferential to the needle bore 60.

The actuator piston 42 has a cylindrical piston body 64 and a piston head 66. The piston body 64 has a generally elongate cylindrical shape. The piston body 64 is operably coupled at a first end to the end of the valve stem 20 of the valve 14. A needle bore 72 is defined in the second end of the piston body 64. The needle bore 72 extends approximately half the longitudinal dimension of the piston body 64. The needle bore 72 is concentric with the longitudinal axis of the actuator piston 42. The piston body 64 is slidably disposed within the piston bore 58*a*, 58*b*.

The piston head 66 is a generally cylindrical shape. The diameter of the piston head 66 is substantially greater than the diameter of the piston body 64. The piston head 66 is disposed within the cylinder bore 52 defined within the actuator casing 40. As depicted in FIG. 1, the piston head 66 divides the cylinder bore 52 into a left variable volume extender chamber 68 and a right variable volume retractor chamber 70. The piston body 64 is translatable within the piston bore 58*a*, 58*b*, and the piston head 66 is translatable therewith within the cylinder bore 52. Such translation in the cylinder bore 52 acts to simultaneously change the volume of the extender chamber 68 and the retractor chamber 70, increasing the volume of one chamber while decreasing the volume of the other chamber.

A plurality of fluted passageways 74 extend through the piston body 64 to accommodate the flow of hydraulic fluid from the LP fluid passageway 54 to the extender chamber 68 (depending on the position of the needle 44) and to the retractor chamber 70. A plurality of fluted passageways 76 extend through the piston body 64 to accommodate the flow of hydraulic fluid from the HP fluid passageway 56 to the extender chamber 68.

The third component of the hydraulic actuator 10 is the needle 44. The needle 44 is a generally elongate cylindrical rod. The needle 44 is disposed at least partially in the needle bore 72 defined in the piston body 64. The needle 44 extends through the needle bore 60 defined in the casing cap 48 of the actuator casing 40. An 0-ring 65 disposed in the 0-ring seal groove 62 effects a fluid seal between the needle 44 and the needle bore 60. The needle 44 is slidably translatably disposed within both the needle bore 60 and the needle bore 72.

The needle 44 extends beyond the casing cap 48 and is operably coupled to a needle positioning mechanism 80. In the depiction of FIG. 1, needle positioning mechanism 80 is a solenoid. Needle positioning mechanism 80 may also be the lobe of a cam or a stepper motor or other suitable positioner as desired.

The inward directed end of the needle 44 is shaped to form a spool valve including a first end groove 82. Groove 82 has a diameter that is substantially less than the inside diameter of the needle bore 72, thereby defining an annular fluid passageway between the first end groove 82 and the needle bore 72. A second groove 84 is defined at approximately the center point along the longitudinal axis of the needle 44. The second groove 84 also has a diameter that is substantially less than the diameter of needle bore 72, thereby defining an annular fluid passageway between the second groove 84 and the needle bore 72.

Operation of Invention

In operation, the hydraulically assisted engine valve actuator 10 relies on low and high pressure fluid. A source of low pressure hydraulic fluid, such as engine lubricating oil, under pressure as the oil is circulated through the engine for lubricating purposes, is operably coupled to the LP fluid passageway 54. A source of high pressure fluid, such as engine oil under pressure as necessary to operate some engine fuel injectors. This source may be operably coupled to the HP fluid passageway 56. Such a high pressure source is described in connection with a hydraulically-actuated, electronically-controlled unit fuel injector system in U.S. Pat. Nos. 5,191,867 and 5,392,749 which are incorporated by reference herein. Translational movement of the needle 44 responsive to input from the needle positioning mechanism 80 distributes hydraulic fluid into and out of the extender chamber 68 and the retractor chamber 70 defined by the position of the piston head 66 of the actuator piston 42 to act on the piston head 66 in such a way (described in detail in the following section) that the actuator piston 42 (and the valve 14 position) very closely follow the translational movement of the needle 44.

The actuator piston 42 acts directly on the engine valve 14, the engine valve 14 being biased to the closed position by the valve spring 26. The valve spring 26 always exerts a leftward directed force on the actuating piston 42, as depicted in FIGS. 1–3*d*. The actuator piston 42 has sufficient rightward directed force, when motivated by high pressure hydraulic fluid, to overcome the opposing bias of the spring 26 and the opposing force of any combustion forces acting on the engine valve 14 in order to open the valve 14.

Translational motion of the needle 44 is not opposed by the spring 26 or the combustion forces and therefore requires only a minimal force exerted by the needle positioning mechanism 80 to effect translation. The needle 44 may be effectively controlled to describe a prescribed valve 14 opening/closing profile. In a preferred embodiment, the actuating force necessary to translate the needle 44 is less than 12 pounds and more preferably is substantially about 6 pounds. The translational position of the needle 44 controls the position of the engine valve 14. Positioning the valve 14 requires a much larger force input than the force input needed to position the needle 44. This much larger force input is available by means of the high pressure hydraulic fluid acting in the extender chamber 68 acting on the actuator piston 42. In this regard, the actuator 10 is a servo follower system. Control is maintained of the needle 44 by the needle positioning system 80. The needle 44 acts as a servo pilot with the actuator piston 42 being the servo main stage and following the needle 44. The force needed to actuate needle 44 is relatively very small compared to the forces that follow the needle 44. This greatly reduces the mass and complexity of the components needed to effect actuation of the valve 14.

FIGS. 2*a*–2*d* depict the opening stroke of the valve 14, sequentially progressing from the closed position in FIG. 2*a* to the open position in FIG. 2*d*. In FIG. 2*a*, the engine valve 14 is initially resting against the valve seat 18 through action of the bias exerted by the valve spring 26. The needle 44 and actuator piston 42 are fully retracted to the leftmost position. Low-pressure fluid enters the LP fluid passageway 54 and flows through the fluted passageways 74 to fill the retractor chamber 70 and then flows through the fluid passageway defined by the first end groove 82 to flood the extender chamber 68 of the actuator piston 42. With low pressure hydraulic fluid acting on both sides 69, 71 of the piston head 66, the actuator piston 42 is in a state of hydraulic equilibrium. No hydraulically generated force is acting to counter the force of the spring 26.

Referring to FIG. 2*b*, the needle positioning mechanism 80 translates the needle 44 rightward. First, such translation advances the shoulder 83 of the first end groove 82 of the needle 44, sealing the extender chamber 68 from the retractor chamber 70. Second, as the needle 44 continues to translate rightward, the needle 44 allows the high pressure fluid supply from HP fluid passageway 56 to flow through the second groove 84 and through the fluted passageways 76. The high pressure fluid communicates with the extender chamber 68 and bears on the extender side face 69 of the piston head 66. Extender side face 69 forms a portion of the variable volume extender chamber 68. It should be noted that the low pressure fluid is always acting on the retractor side face 71 of the piston head that forms a portion of the retractor chamber 70. The high pressure oil in the extender chamber 68 drives the actuator piston 42 and engine valve 14 to the open position (FIG. 2*c*), overcoming the opposing force of the spring 26 and the opposing force of the low pressure fluid acting on the side 71 of the piston head 66 that forms a portion of the retractor chamber 70. In a preferred embodiment, the high pressure fluid operates in a pressure range of approximately 450 psi to 3000 psi and the low pressure fluid operates at a pressure of approximately 50 psi.

The rate of rightward translational displacement of the needle 44 determines the area of the fluid passageway opening defined between the second groove 84 and the fluted passageways 76 to the extender chamber 68 and thereby meters the high pressure fluid from the high pressure supply at the HP fluid passageway 56 that is available to act upon the side 69 of the piston head 66 that forms a portion of the extender chamber 68. This metering permits control of the opening profile of the valve 26, as desired. The faster the needle 44 continues to move rightward, the less the throttling effected on the high-pressure oil and the greater the volume of the high pressure fluid supply that the needle 44 allows to communicate with the extender chamber 68 to act upon the side 69 of the piston head 66 that forms a portion of the extender chamber 68. The high pressure fluid in the extender chamber 68 drives the actuator piston 42 and engine valve 14 to the opening position, overcoming the force of the spring 26 and the opposing force of the low pressure fluid acting on the side 71 of the piston head 66 that forms a portion of the retractor chamber 70.

Conversely, the slower the displacement of the needle 44, the less area of the fluid passageway defined by the second groove 84 that is open to the fluted passageways 76 and thence to the extender chamber 68 and the greater the throttling effect on the high pressure oil. The resulting lower high pressure oil volume in the extender chamber 68 results in less force available to overcome the force of the spring 26, compression or combustion forces acting to close the engine valve 14, and the opposing force of the low pressure fluid acting on the side 71 of the piston head 66 that forms a portion of the retractor chamber 70. This in turn results in slower movement of the actuator piston 42 and results in a valve profile that is characterized by slower opening movement of the engine valve 14.

Referring to FIG. 2*d*, when the needle 44 is brought to a stop at its point of greatest rightward translation, the pressure in the extender chamber 68 and the inertia of the actuator piston 42 cause the actuator piston 42 and valve 14 to continue their rightward motion for a short distance until the shoulder 85 of the second groove 84 of the needle 44 seals the fluted passageway 76, preventing further high pressure fluid from affecting the extender chamber 68 of the piston actuator 42. A balance then ensues between the fluid trapped in the extender chamber 68 by the needle 44 and the opposing bias of the spring 26.

The closing stroke of the valve 14 effected by actuator 10 is depicted sequentially in FIGS. 3*a*–3*d*. Referring to FIG. 3*a*, the needle 44 and actuator piston 42 are initially positioned such that the engine valve 14 is unseated at some lift (at least partially open) as a result of the last action in the open stroke referred to with reference to FIG. 2*d* above. The needle 44 seals the extender chamber 68 from both the high and low pressure oil supplies, as previously described in reference to FIG. 2*d*.

Referring to FIG. 3*b* the needle positioning mechanism 80 retreats the needle 44, causing leftward translation of the needle 44. The movement of the needle 44 opens the fluid passageway defined circumferential to the first end groove 82 to fluidly connect the extender chamber 68 to the retractor chamber 70. As previously indicated, the retractor chamber 70 is always exposed to the low pressure oil supply at LP fluid passageway 54. The extender chamber 68 is isolated from the high pressure oil at HP fluid passageway 56 by the needle 44 proximate the second groove 84. The second groove 84 is positioned to isolate the fluted passageways 76 from the high pressure fluid supply at passageway 54. The high pressure fluid in the extender chamber 68 flows into the retractor chamber 70 until extender chamber 68 and the retractor chamber 70 are in a state of hydraulic pressure equilibrium. The force of the spring 26, which is always acting on the actuator piston 42, drives the engine valve 14 and actuator piston 42 leftward towards the closed position, as depicted in FIG. 3*c*.

The rate at which the needle 44 retreats is determined by the needle positioning mechanism 80 and determines the area of the fluid passageway fluidly communicating between the retractor chamber 70 and the extender chamber 68, thereby metering the high pressure fluid flow from the extender chamber 68 to the retractor chamber 70. The force of the spring 26 acts to push the engine valve 14 and actuator piston 42 to the closed position as the high pressure fluid is discharged from the extender chamber 68. The faster that the needle 44 is displaced leftward, the larger the area and the faster the rate at which the oil is discharged from the extender chamber 68 to the retractor chamber 70. The oil in the extender chamber 68 must be displaced in order for the valve 14 to close. The rate of displacement of the needle 44 closely controls the rate of valve 14 closure. Control of the rate of translation of the needle 44 thereby affords close control of the profile of the closing of the valve 14.

When the needle 44 is brought to a stop, as depicted in FIG. 3*d*, the force of the spring 26 and of inertia act to continue the leftward motion of the actuator piston 42 towards the closed position for a small amount of travel after needle 44 stoppage. Such travel continues until the extender chamber 68 is sealed from the retractor chamber 70 by the shoulder of the first end groove 82. A balance then ensues between the fluid pressure in the extender chamber 68 and the retractor chamber 70. The force of the spring 26 continues to act on the actuator piston 42 and the valve 14, maintaining the valve 14 in the seated closed position.

FIGS. 4*a*–4*d* depict a comparison of a cam valve train engine exhaust valve 14 profile with a camless profile effected by the present invention wherein an aggressive valve opening is selected and controlled around bottom dead center. The FIGS. 4*b*–4*d* depict actuator flow rate, piston forces, and actuator pressures corresponding to motion depicted in FIG. 4*a*. The FIG. 4*a* shows the engine piston motion profile, cam valve train profile of a conventional system, needle position of the present invention, and response of the piston actuator of the present invention and engine valve to the needle position input. FIG. 4*a* depicts how closely the output in the form of motion of valve 14 tracks the input in the form of needle 44 position, thus obviating the need for a sensor to track position of the valve 14. FIG. 4*b* depicts flow rate of high pressure oil needed to effect a valve opening and closing cycle. FIG. 4*c* depicts the force of the high pressure oil acting on the actuator 42 in comparison to the opposing force of the spring 26. FIG. 4*d* indicates that the pressure needed to keep the valve open stabilizes at about 400 psi after 0.02 seconds. Virtually any high pressure hydraulic fluid that is above the threshold of about 400 psi is adequate to cause the actuator 10 to function as designed.

Turning now to FIGS. 5*a*–5*f*, a hydraulic schematic of the operation of an embodiment of the hydraulic actuator 10 is depicted sequentially through a downstroke of the valve 14 and an upstroke of the valve 14. In order to effect the downstroke of the valve 14, there are two downward motions that must be considered. First, the actuator piston 42 is coupled to the valve 14 and drives the valve 14 in the downward direction as depicted. Second, the needle 44 translates within the needle bore 72 defined in the actuator piston 42 under the influence of the needle positioning mechanism 80 to control the motion of the actuator piston 42.

Figure 5A:
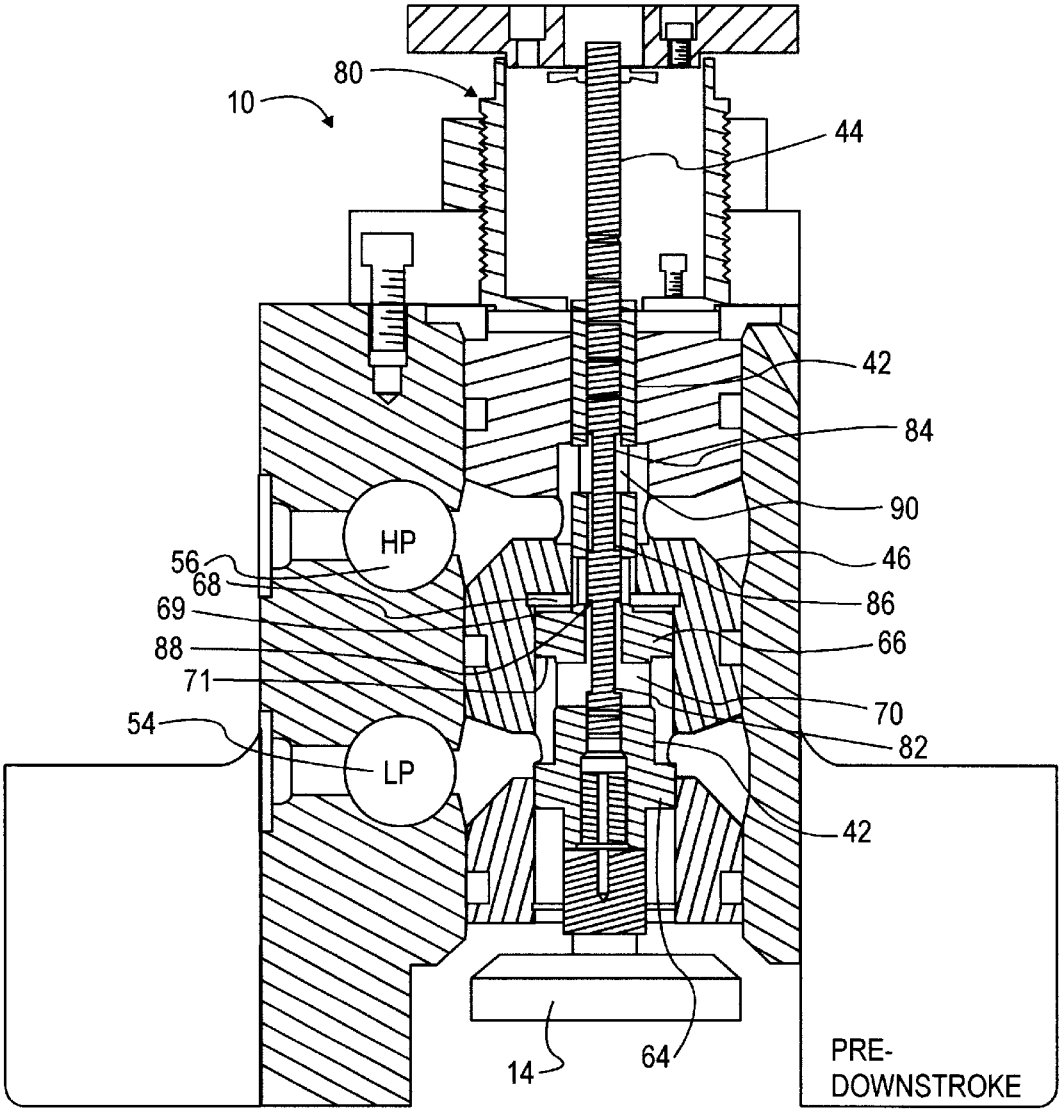
FIGS. 5*a*–5*b* are hydraulic schematics depicting the valve opening cycle and the valve closing cycle in sequence. Specifically.

Prior to commencement of the downstroke of the valve 14, the actuator piston 42 and the needle 44 are in their fully retracted and upward positions as depicted in FIG. 5*a*. High pressure lubricating oil available at the high pressure fluid passageway 56 from a high pressure rail floods the chamber 90 and flows into the second groove 84. The second groove 84 is sealed at its downward most end by the shoulder 86 of the needle 44 sealingly engaging the actuator piston 42.

Low pressure engine lubricating oil available at the low pressure fluid passageway 54 from a low pressure rail floods the retractor chamber 70. The low pressure engine lubricating oil is prevented from entering the extender chamber 68 by a sealing engagement of the shoulder 88 of the needle 44 with the actuator piston pin 42.

The valve 14 is kept in its fully upward seated disposition, as depicted in FIG. 5*a*, by the action of the low pressure engine lubricating oil acting on the retractor surface 71 of the piston head 66, in combination with the bias exerted by the valve spring 26. See FIG. 1.

Figure 5B:
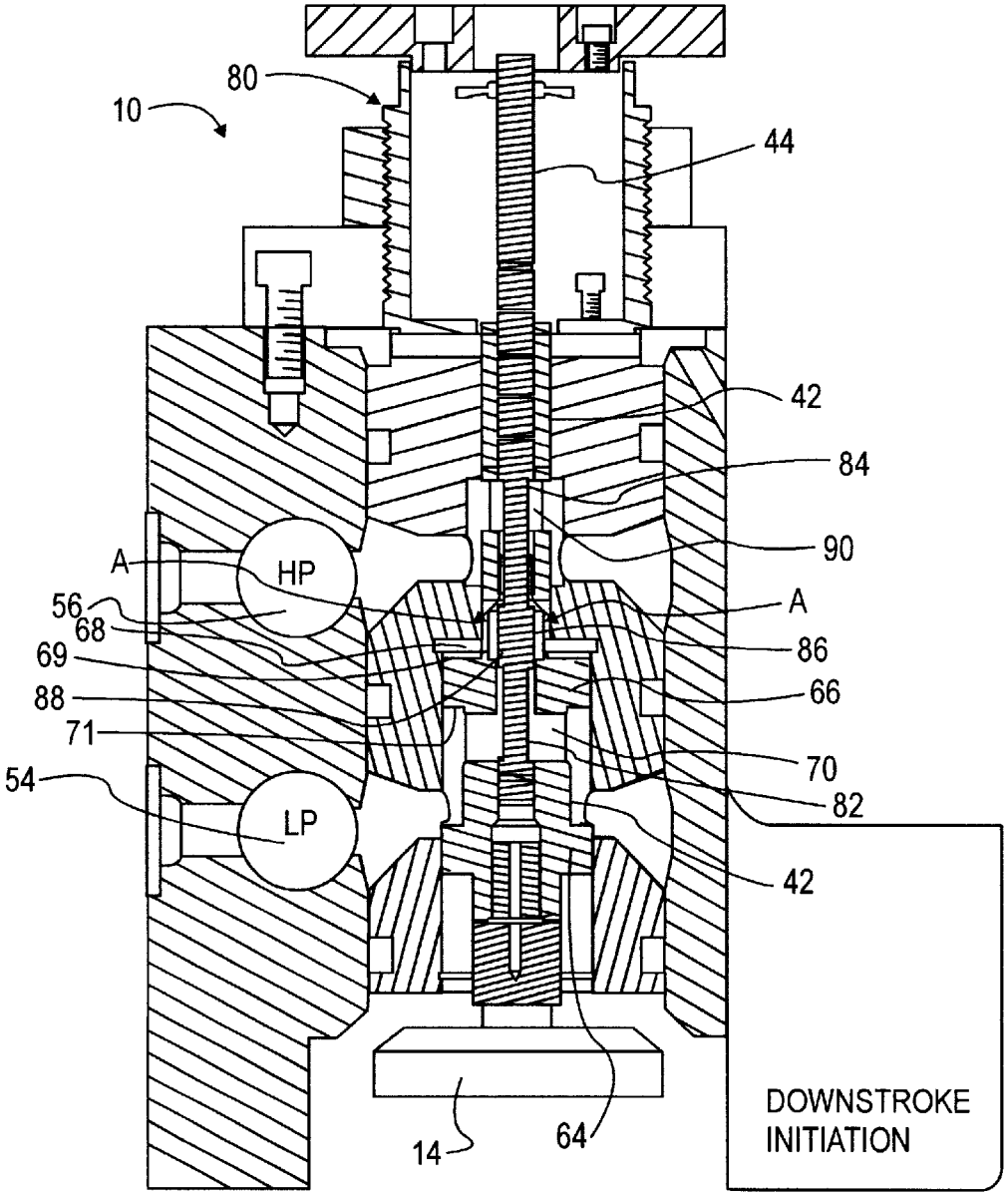

FIG. 5*b* depicts the initiation of the downstroke of the valve 14. In FIG. 5*b*, the needle 44 has translated downward relative to the actuator piston 42 under the actuating influence of the needle positioning mechanism 80. Such downward translation backs the shoulder 86 of the needle 44 out of engagement with the actuator piston 42 to create a fluid passageway through the second groove 84 to the extender chamber 68. High pressure engine lubricating oil flows through the second groove 84 into the extender chamber 68 and bears on the extender surface 69 of the piston head 66. The force exerted by the high pressure engine lubricating oil is sufficient to overcome the countering force exerted by the engine pressure lubricating oil acting on the retractor surface 71 in combination with the bias exerted by the valve spring 26 and any combustion forces acting on the valve 14. Accordingly, translation of the actuator piston 42 and the coupled valve 14 commences downward very closely trailing the translation of the needle 44. The flow of high pressure engine lubricating oil into the extender chamber 68 is depicted by arrows A. The extender chamber 68 remains sealed from the retractor chamber 70 by the sealing action of the shoulder 88 in a sealing relationship with the piston head 66. Low pressure oil continues to flood the retractor chamber 70.

Figure 5C:
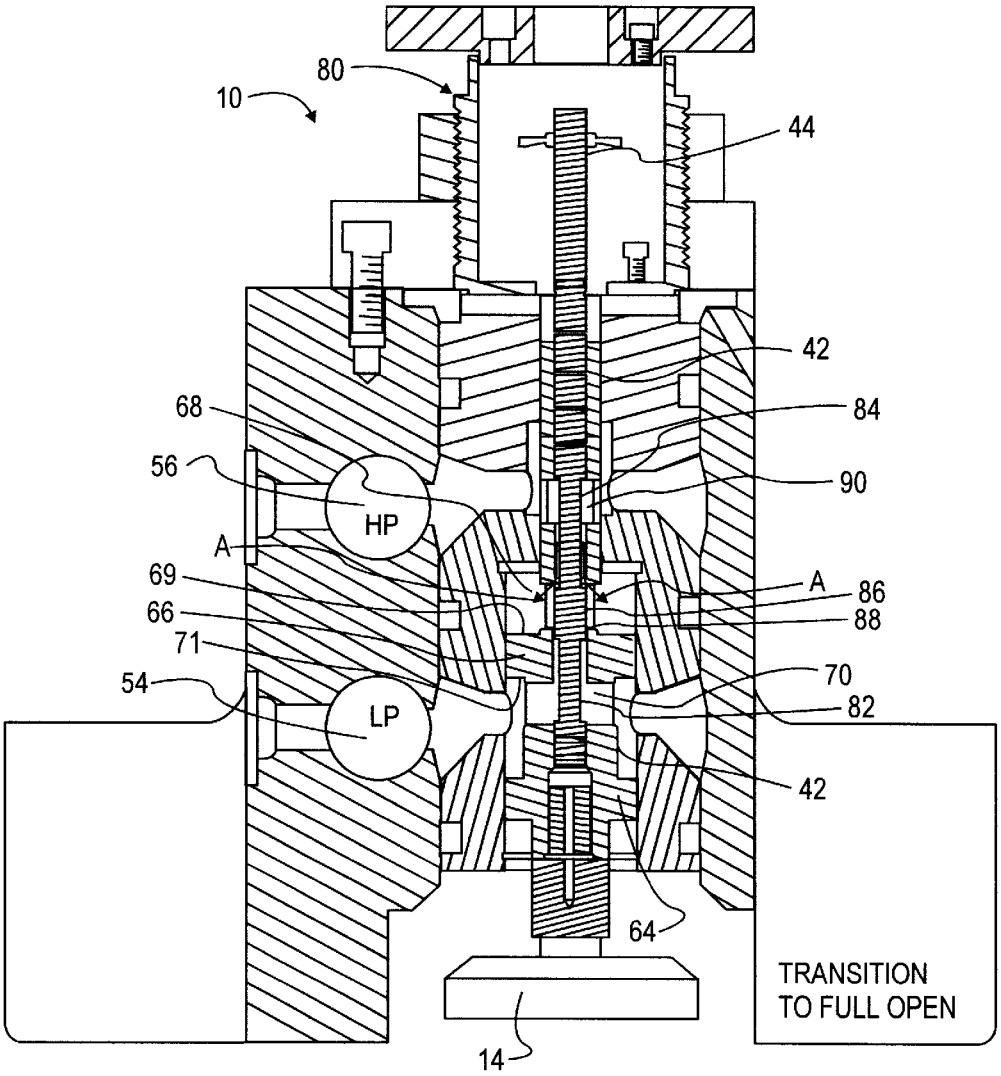
FIG. 5*c* is a side elevational view in section of the valve actuator with the actuator needle in a downward position and the valve approaching the open extended configuration.

FIG. 5*c* depicts the valve 14 as the valve 14 approaches the downward, fully open, unseated position. In the depiction of FIG. 5*c*, the needle 44 has translated downward its full travel. The actuator piston 42 lags slightly behind the needle 44. Accordingly, as indicated by arrows A, high pressure engine lubricating oil continues to flood the extender chamber 68 and to act on the extender surface 69, thereby urging the actuator piston 42 and the valve 14 in the downward direction.

Figure 5D:
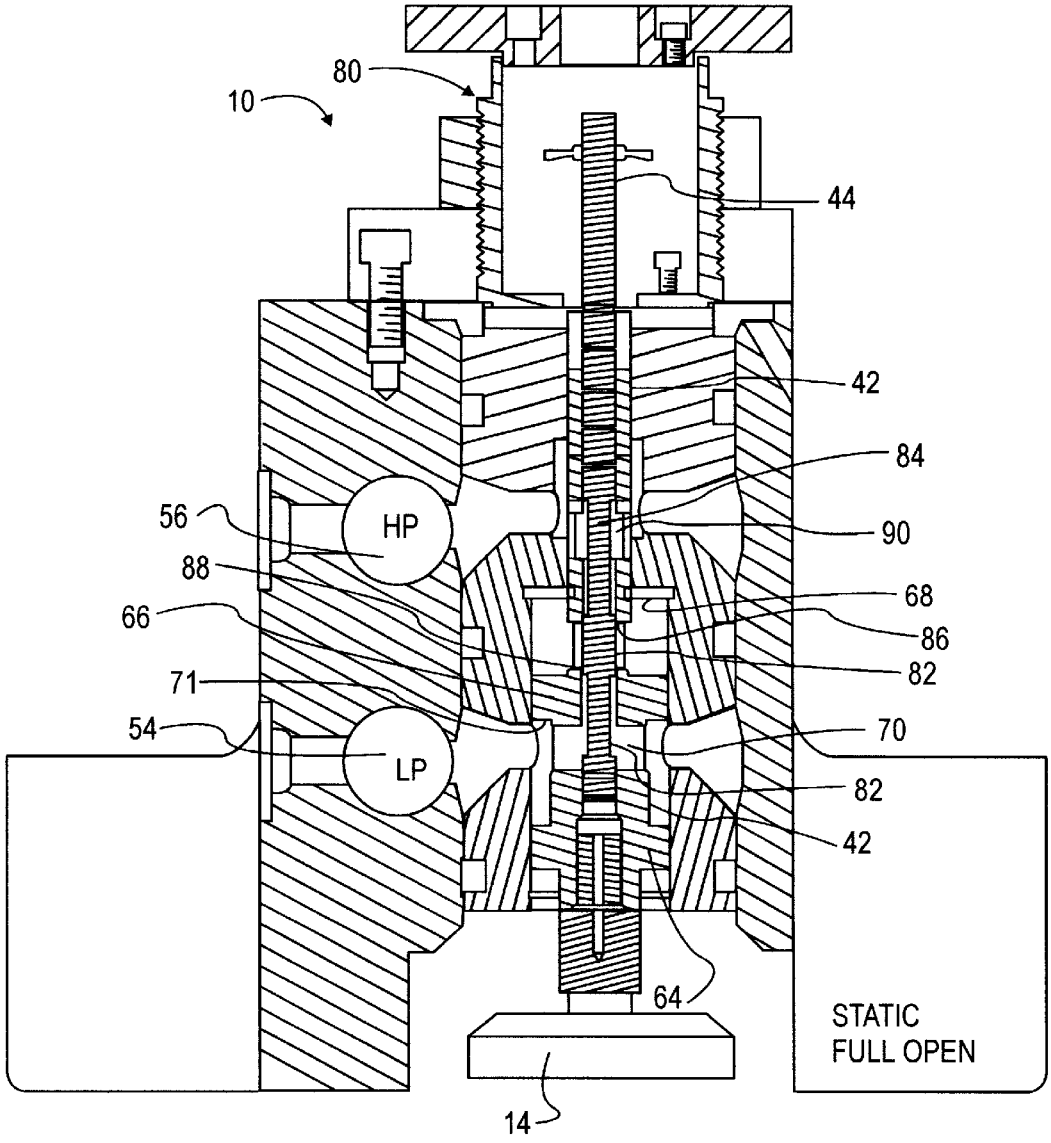
FIG. 5*d* is a side elevational view in section of the valve actuator with the actuator needle and the valve stopped in the open extended configuration.

FIG. 5*d* depicts the valve 14, the actuator piston 42, and the needle 44 all in their fully downward positions. As compared to FIG. 5*c*, the actuator piston 42 has continued to translate downward slightly relative to the needle 44 after motion of the needle 44 has ceased. This translation results generally from the inertia of the actuator piston 42 and the valve 14. Such translation seals the extender chamber 68 by the action of the shoulder 86 of the needle 44 again sealingly engaging the actuator piston 42. Additionally, the shoulder 88 of the needle 44 is in sealing engagement with the actuator piston 42, thereby isolating the retractor chamber 70 from the extender chamber 68. In this position, there is no flow of either high pressure engine lubricating oil or low pressure engine lubricating oil. This is essentially a static position. High pressure engine lubricating oil is sealed within the extender chamber 68 creating a hydraulic lock, preventing the lower pressure engine lubricating oil that is acting on the retractor surface 71 of the piston head 66 (in combination with the bias of the valve spring 26) from moving the actuator piston 42 in an upward direction. Flow into or out of retractor chamber 70 ceases since all passages are sealed and there is no motion of the actuator piston 42.

Figure 5E:
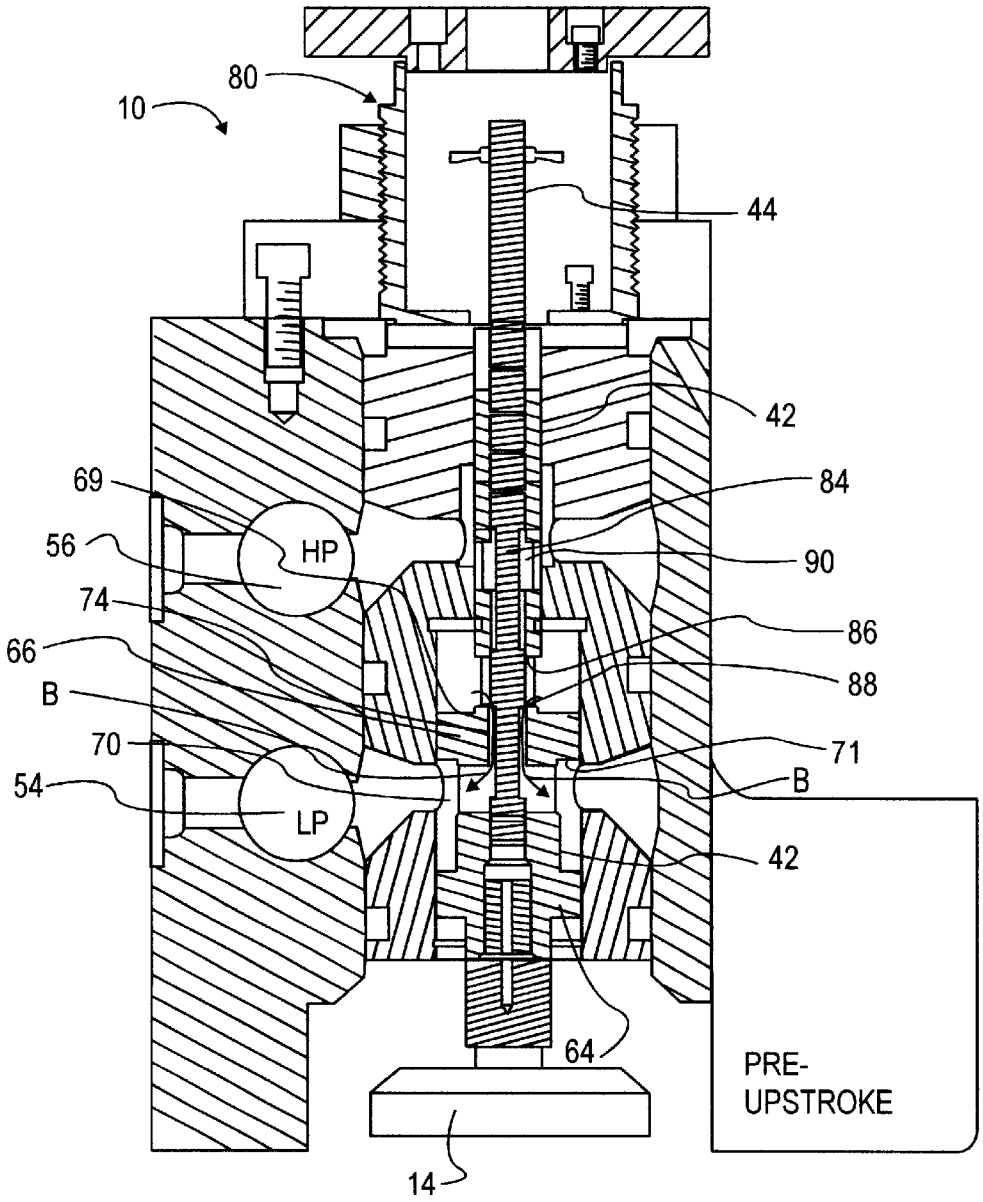
FIG. 5*e* is a side elevational view in section of the valve actuator with the actuator needle commencing upward retraction and the valve in the open extended configuration.

Referring to FIG. 5*e*, the commencement of the upstroke of the valve 14 is depicted. In FIG. 5*e*, the needle 44 has translated upward slightly under the influence of the needle positioning mechanism 80. Such upward translation backs the shoulder 88 out of the sealing engagement with the actuator piston 42. The shoulder 86 remains in sealing engagement with the actuator piston 42. The translation of the needle 44 opens a fluid passageway from the extender chamber 68 through the first groove 82 and then through to the retractor chamber 70. The pressure of the high pressure hydraulic actuating fluid (engine lubricating oil) trapped in the extender chamber 68 is dissipated into the retractor chamber 70 as indicated by the arrows B. With the dissipation of the hydraulic lock as depicted in FIG. 5*d*, there is hydraulic equilibrium in chambers 68, 70 and the bias of the valve spring 26 is therefore free to act on the valve 14 and the actuator piston 42.

Figure 5F:
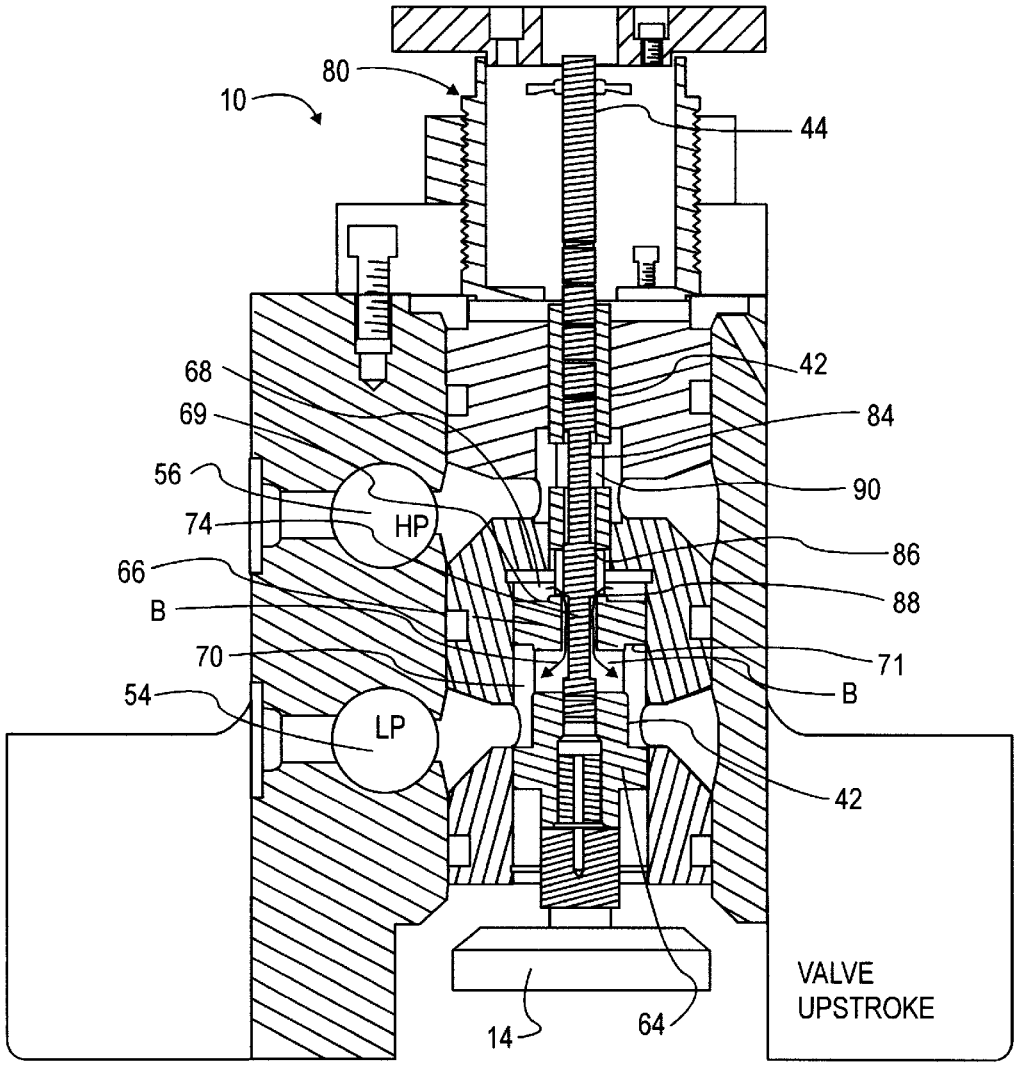
FIG. 5*f* is a side elevational view in section of the valve actuator with the actuator needle and valve in the open extended configuration, the actuator needle having retracted upward exposing the extender chamber to low pressure hydraulic fluid and the valve in the closed retracted configuration.

Referring to FIG. 5*f*, the upward bias of the valve spring 26 (depicted in FIG. 1) acting on the valve 14 forces the actuator piston 42 upward. The upward motion of the actuator piston 42 displaces substantially all the hydraulic actuating fluid from the extender chamber 68 into the retractor chamber 70, as depicted by arrows B. As indicated in FIG. 5*f*, the shoulder 88 is disengaged from the actuator piston 42 to permit the continued flowing of engine lubricating oil from the extender chamber 68 to the retractor chamber 70. The needle 44 retracts upward with the actuator piston 42 causing the shoulder 86 to maintain a sealing engagement with the actuator piston 42, thereby isolating the high pressure engine lubricating oil from the extender chamber 68. This completes the upstroke of the valve 14.

A further preferred embodiment of the present invention is depicted in FIGS. 6 and 7*a*–7*d*.

Referring to FIG. 6 and 7*a*–7*d*, the valve actuator module 100 of the present invention is utilized with a valve 112 preferably disposed in a head 120 of an internal combustion engine. The valve 112 has a valve stem 114. An upper end of a valve spring 116 is retained by a valve rotator 118. The lower end (not shown) of the valve spring 116 is conventionally retained in the head 120.

The head 120 has a main piston bore 122 and a drive piston bore 124 defined therein. The bores 122, 124 are generally parallel and offset in a spaced apart relationship. A somewhat smaller diameter secondary piston bore 128 is defined concentric with the drive piston bore 124. The secondary piston bore 128 and the drive piston bore 124 are coaxial with the longitudinal axis of the engine valve stem 114.

A low pressure oil passage 130 is defined in the head 120 extending between the main piston bore 122 and the secondary piston bore 128. A high pressure oil passage 132 is defined in the head 120 extending between and fluidly coupling the main piston bore 122 and the drive piston bore 124.

A low pressure rail 134 is defined in the head 120. The low pressure rail 134 is fluidly coupled to the main piston bore 122. The lube pressure rail 134 preferably conveys engine lubricating oil at normal engine lubricating oil pressures of approximately 50 psi. A high pressure rail 136 is also defined in the head 120. The high pressure rail 136 is fluidly coupled to the main piston bore 122. The high pressure rail 136 preferably conveys a high pressure actuating fluid for actuation of the valve 112. The high pressure actuation fluid is preferably engine lubricating oil elevated to high pressure by a special pump, the high pressure being in the range of 1,000 to 4,000 psi. The low pressure rail 134 and the high pressure rail 136 are selectively in fluid communication with the main piston bore 122.

A smaller volume low oil pressure line 138 is also defined in the head 120. The low pressure line 138, like the low pressure rail 134, preferably conveys engine lubricating oil at engine lubricating oil pressures. The low pressure oil line 138 is in fluid communication with the secondary piston bore 128.

The valve actuator module 100 of the present invention includes five major components: controller 140, needle 142, main piston 144, drive piston 146, and secondary piston 148. The controller 140 is preferably fixedly coupled to the head 120. The controller 140 has a controller housing 150 having a lower portion 152 that is sealably disposed within an enlarged upper extension of the main piston bore 122. The lower margin 154 of the lower portion 152 defines in part a control chamber 156. The control chamber 156 will be described in greater detail below. A depending cylindrical shoulder 158 having an open portion aligned with the low pressure oil passage 130 projects into the volume defined by the main piston bore 122.

The controller 140 further includes a solenoid 160. The solenoid 160 has a fixed armature 162 and a translatable core 164 disposed within the armature 162. The core 164 has an actuator rod 166 that is slidably disposed within a bore defined in the lower portion 152 of the controller housing 150. The actuator rod 166 pushes the needle 142 or, in an embodiment, the needle 142 may be formed as a portion of the actuator rod 166. The solenoid 160 has a linear stroke of less than about 6mm and more preferably is about 4mm.

Needle 142 is the second component of the valve actuator module 100. The needle 142 is a generally elongate metal rod having a longitudinal axis that is coaxial with the longitudinal axis of the main piston bore 122. The cylindrical periphery of the needle 142 has a generally centrally disposed groove 168. The upper and lower margins of the groove 168 are defined by a low pressure shoulder 170 and by a high pressure shoulder 172. The groove 168, in cooperation with the low pressure shoulder 170 and the high pressure shoulder 172, defines in part an annular fluid passageway 174 between the needle 142 and a needle bore 180 defined in the main piston 144.

An upward bias is exerted on the needle 142 (and the actuator rod 166) by a return spring 176 disposed partially within the needle bore 180 and is concentric with the longitudinal axis of the needle bore 180. The return spring 176 acts on the lower margin of the needle 142. The return spring 176 is retained within the main piston bore 122 by a keeper 178 disposed within the main piston bore 122.

The main piston 144 is the third component of the valve actuator module 100. The main piston 144 is translatably disposed within the main piston bore 122. In order to simplify machining tolerances, the main piston 144 is dependent only on the concentricity of the main piston bore 122. Likewise, the needle 142 is dependent on only the concentricity of the needle bore 180 defined in the main piston 144. Multiple dependencies, as distinct from the single dependencies of the present invention, and undesirable as they may greatly increase the requirements for highly accurate concentricity of the multiple dependent bores of the translatable components of a valve actuator.

The main piston 144 has an upwardly directed piston head 182. The piston head 182 defines in part the control chamber 156. A low pressure groove 184 is defined in the outer periphery of main piston 144. A fluid passage 186 is defined at the lower margin of the low pressure groove 184 and extends through the main piston 144 to fluidly couple the low pressure rail 134 to the needle bore 180. The lower margin of the fluid passage 186 is defined by a low pressure shoulder 188.

A first high pressure groove 190 is also defined in the outer periphery of the main piston 144 below and fluidly isolated from the low pressure groove 184. A fluid passage 192 is defined at the lower margin of the first high pressure groove 190 and extends through the main piston 144 to fluidly couple the needle bore 180 and the high pressure oil passage 132 defined in the head 120. A second high pressure groove 193 is also defined in the outer periphery of the main piston 144 below and isolated from the first high pressure groove 190. A high pressure fluid passage 194 is defined at the upper margin of the second high pressure groove 193 and extends through the wall of the main piston 144 to fluidly couple the high pressure rail 136 defined in the head 120 with the needle bore 180 defined in the main piston 144. The upper margin of the high pressure fluid passage 194 is a high pressure shoulder 195.

An upward bias is exerted on the main piston 144 by a return spring 196 acting on the lower margin of the main piston 144. The return spring 196 is disposed concentric with the return spring 176 of the needle 142. Return spring 196 of the main piston 144 is also retained within the main piston bore 122 by the keeper 178. It should be noted that the needle 142 and main piston 144 are offset from the engine valve 112 and are structurally decoupled from the engine valve 112. This acts to decouple the needle 142 and the main piston 144 from the effects of valve lash of the engine valve 112.

The fourth component of the valve actuator module 100 is the drive piston 146. The drive piston 146 is translatably disposed within the drive piston bore 124 defined in the head 120. The drive piston 146 has an upper margin presenting a drive piston head 198 that is exposed to hydraulic actuating fluid flowing in high pressure oil passage 132. The drive piston 146 pushes onto the engine valve piston 112. Downward motion of the drive piston 146 acts on the engine valve stem 114 to open the engine valve 112.

The fifth component of the valve actuator module 100 is the secondary piston 148. The secondary piston 148 is biased downward by a secondary piston spring 200 that resides in the secondary piston bore 128. The secondary piston spring 200 is retained within the bore 128 by a keeper 202. The secondary piston 148 has a secondary piston head 204. The secondary piston head 204 defines in part the control chamber 156. An elongate piston rod 206 extends through a bore 207 defined in the head 120. The bore 207 extends between the control chamber 156 and the high pressure oil passage 132. The piston rod 206 has a distal end 208 that bears on the drive piston head 198. The distal end 208 is kept in contact with the drive piston head 198 by the bias exerted by the secondary piston spring 200.

The control chamber 156 has a variable volume and is preferably kept filled and replenished with engine oil from the lube oil line 138. The control chamber 156 has a check valve 210 interposed between the control chamber 156 and the low pressure oil line 138. The check valve 210 is biased to a closed disposition, sealing the control chamber 156 from the low pressure line 138 by a check valve spring 212. The check valve 210 will be unseated by the pressure of the low pressure engine oil in the low pressure line 138 whenever the pressure in the low pressure line 138 exceeds the force generated on the check valve 210 by the combination of the pressure in the control chamber 156 and the bias exerted on the check valve 210 by the check valve spring 212.

Figure 6:
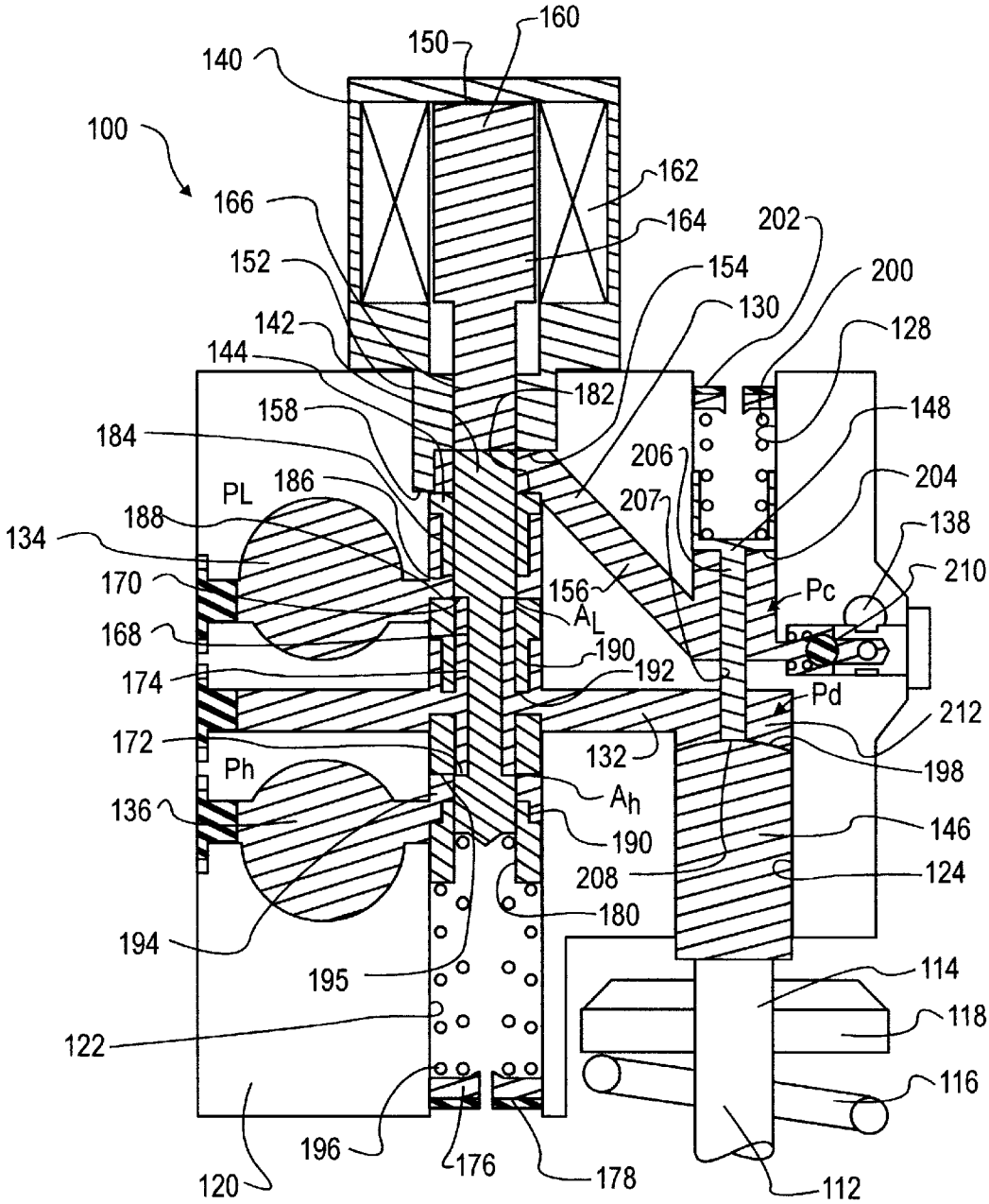
FIG. 6 is a sectional view of an embodiment of a valve actuator.
Figure 7A:
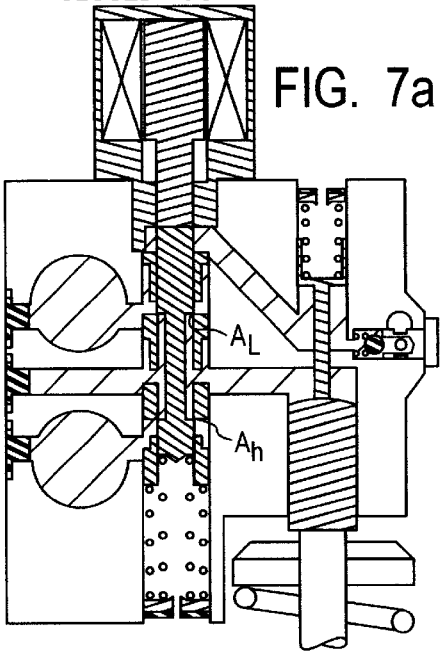
FIG. 7*a* is a sectional view of an embodiment of the valve actuator of FIG. 6 in the engine valve closed position.

Operation of the valve actuator module 100 may be appreciated with reference to FIGS. 7*a*–7*d*. FIG. 7*a* (like FIG. 6) depicts the engine valve 112 in the closed position. The engine valve spring 116 maintains the engine valve 112 in the upward closed position. The needle 142 and the main piston 144 are in the fully upward, retracted position. The piston head 182 of the main piston 144 bears on the shoulder 158 of the controller housing 150, the shoulder 158 acting as a stop for the main piston 144. The low pressure throttling area, $A_L$, defined by the interaction of the low pressure shoulder 170 of the spool groove 168 and the low pressure shoulder 188 of the fluid passage 186, is open, permitting the lube pressure rail 134 to be in fluid communication with the drive piston head 198. Accordingly, the pressure $P_D$ acting on the drive piston 146 is equal to the pressure in the lube pressure rail 134. In this position, high pressure throttle area $A_H$, defined by the interaction between the high pressure shoulder 172 of the groove 168 and the high pressure shoulder 195, is closed. When the shoulders 172, 195 overlap, the high pressure throttle area $A_H$ is closed, thereby sealing off the high pressure rail 136.

Figure 7B:
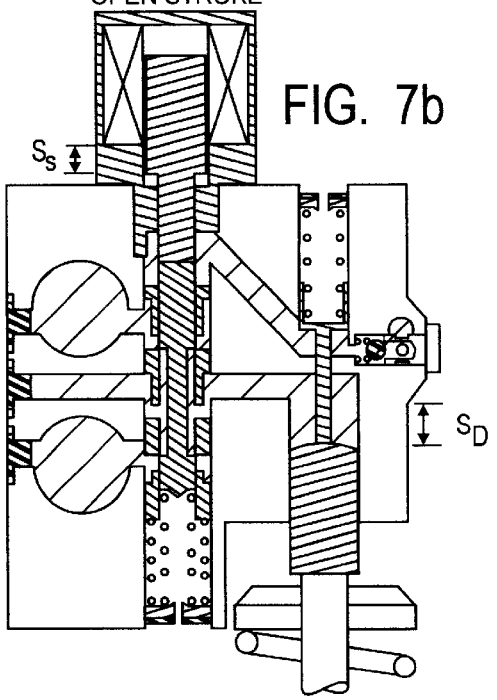
FIG. 7*b* is a sectional view of an embodiment of the valve actuator of FIG. 6 in the engine valve open stroke position.

Referring to FIG. 7*b*, the engine valve 112 is shown in its fully open disposition. By comparing FIGS. 7*a* and 7*b*, it is seen that the stroke, $S_s$, of the solenoid 160 is approximately one-half the stroke, $S_D$, of the drive piston 146 and the engine valve 112. The main piston 144 under influence of the fluid in the control chamber 156 is utilized to in effect double the length of the stroke $S_s$ of the solenoid 160 to achieve the stroke, $S_D$, of the engine valve 112. The ratio of the area of the secondary piston 148 to the area of the main piston 144 determines the stroke magnification. By appropriately sizing the pistons 144, 148, ratios of greater than 1:1 and as much as 1:6 may be achieved. However, a ratio of about 1:2 is preferred where the solenoid 160 gives a linear stroke of about 6mm and a 12mm stroke of the engine valve 112 is desired.

In FIG. 7*b*, the needle 142 is shown extended fully downward. High pressure oil is routed from the high pressure rail 136 through the high pressure fluid passageway 194. The high pressure throttle area, $A_H$ (defined by the spaced apart shoulders 172, 195), is open permitting high pressure actuating fluid to pass through the annular fluid passageway 124, the high pressure oil passage 132 to act on the drive piston head 198. The high pressure actuating fluid drives the drive piston 146 and the engine valve 112 downward to the engine valve open position. The low pressure throttle area, $A_L$, is closed (the shoulders 170, 188 being in an overlapped relationship) preventing fluid communication with the low pressure rail 134. The secondary piston 148 is coupled to the drive piston 146 by means of the bias exerted by the spring 200. As the secondary piston 148 translates downward, oil in the control chamber 156 is pumped to bear downward on the piston head 182 of the main piston 144. Accordingly, the main piston 144 translates downward slightly lagging the translation of the needle 142.

Figure 7C:
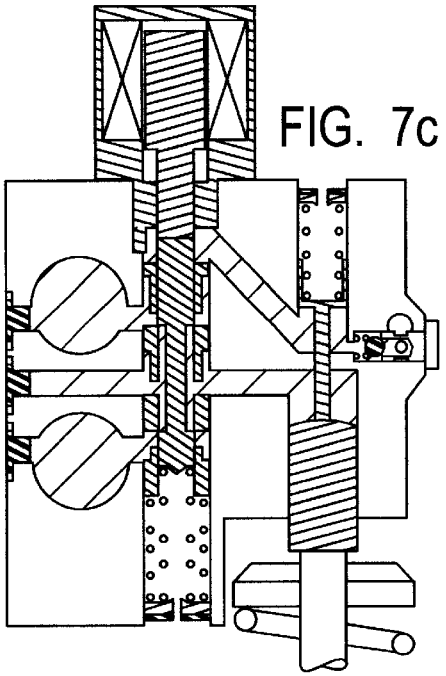
FIG. 7*c* is a sectional view of an embodiment of the valve actuator of FIG. 6 in the engine valve close stroke position.

Referring to FIG. 7*c*, the closing stroke of the valve actuator module 100 and the engine valve 112 is depicted. The closing stroke is commenced by upward retraction of the needle 142 as commanded by the solenoid 160. As the solenoid 160 retracts, the return spring 176 acts upward on the needle 142 to assist in the retraction of the needle 142. The retraction of the needle 142 relative to the main piston 144 opens the low pressure throttle area *AL*, to the low pressure rail 134. The high pressure oil acting on the drive piston head 198 escapes through the high pressure oil passage 132, the annular fluid passage 174, and the low pressure throttle area, *AL*, to the low pressure rail 134. Once the high pressure actuating fluid no longer is acting on the drive piston head 198, the valve spring 116 acts to return the engine valve 112 to its closed position. As the drive spring 146 moves upward, the secondary piston 148 also moves upward. As the secondary piston 148 moves upward it alters the volume of the control chamber 156. The return spring 196 acting upward on the main piston 144 pumps the fluid in the control chamber 156 to the secondary piston 148. Upward translation of the main piston 144 occurs, slightly lagging the retraction of the needle 142. Such lagging translation ensures that the high pressure throttle area ($A_H$) remains closed during the upward translation of the needle 142 and the main piston 144.

Figure 7D:
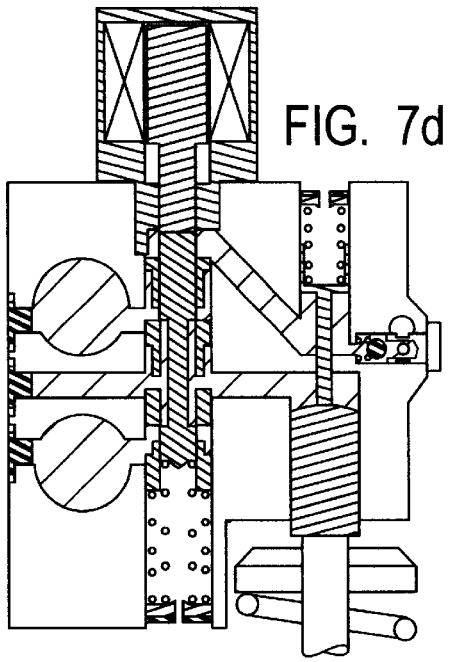
FIG. 7*d* is a sectional view of an embodiment of the valve actuator of FIG. 6 in the valve lash adjustment position.

Lash adjustment occurs as depicted in FIG. 7*d*. A certain amount of fluid leakage is designed into the control chamber 156. As a result of such leakage, the main piston 144 seats against the shoulder 158, thereby terminating its upward translation slightly ahead of the secondary piston 148 completing its upward translation. The secondary piston 148 continues its upward translation after the seating of the main piston 144. Such upward translation momentarily decreases the pressure in the control chamber 156 to a pressure that is less than the pressure in the low pressure line 138. This momentary decrease of pressure in the control chamber 156 results in the oil pressure in the low pressure line 138 acting on the check valve 210 to compress the check valve spring 212 and to admit a replenishing quantity of oil into the control chamber 156. By always seating the main piston 144 ahead of the secondary piston 148, there is always a brief period of time during which the control chamber 156 may be fully filled without regard to changes in the longitudinal dimension (lash) of the engine valve stem 114.

With such an accommodation of valve lash, where the drive piston 146 stops in its retracted disposition is of no concern in the valve actuation operation. The effect of the drive piston 146 stop position on the volume of the control chamber 156 is countered by the automatic refilling of the control chamber 156. The volume of the control chamber 156 can change due to valve lash, but the variable volume of the control chamber 156 is always refilled as described above. The foregoing arrangement always ensures that the main piston 144 seats on each upward stroke. This is very important because of the critical relationship between the main piston 144 and the needle 142 especially with regard to the low pressure throttle area, A*L*, and the high pressure throttle area, A*H*. A misalignment of the needle 142 and the main piston 144, which would result from the main piston 144 not seating on its retracting stroke, can greatly affect the desired flow of fluids in the valve actuator module 100.

A further embodiment of the valve actuator of the present invention is depicted in FIGS. 8–18*b*. In these figures, like numerals depict like components as described above.

The valve actuator module 100 as depicted in FIGS. 8–18*b* results in a number of advantages including, solenoid size reduction, more effective use of packaging, and the elimination of effects of valve growth (lash) and valve seat wear. In order to achieve such advantages, the drive piston 146 is decoupled from the needle 142 in order to ease packaging arrangements and to effect height reduction. Such decoupling allows for implementation of a check valve 210 on the coupling fluid volume (control chamber 156) which serves as a hydraulic lifter. The decoupling further allows for a variable ratio between the needle 142 and the drive piston 146. A shorter needle 142 stroke permits a more compact solenoid unit (controller 140), since it is the solenoid 160 that generates the needle 142 stroke.

Figure 8:
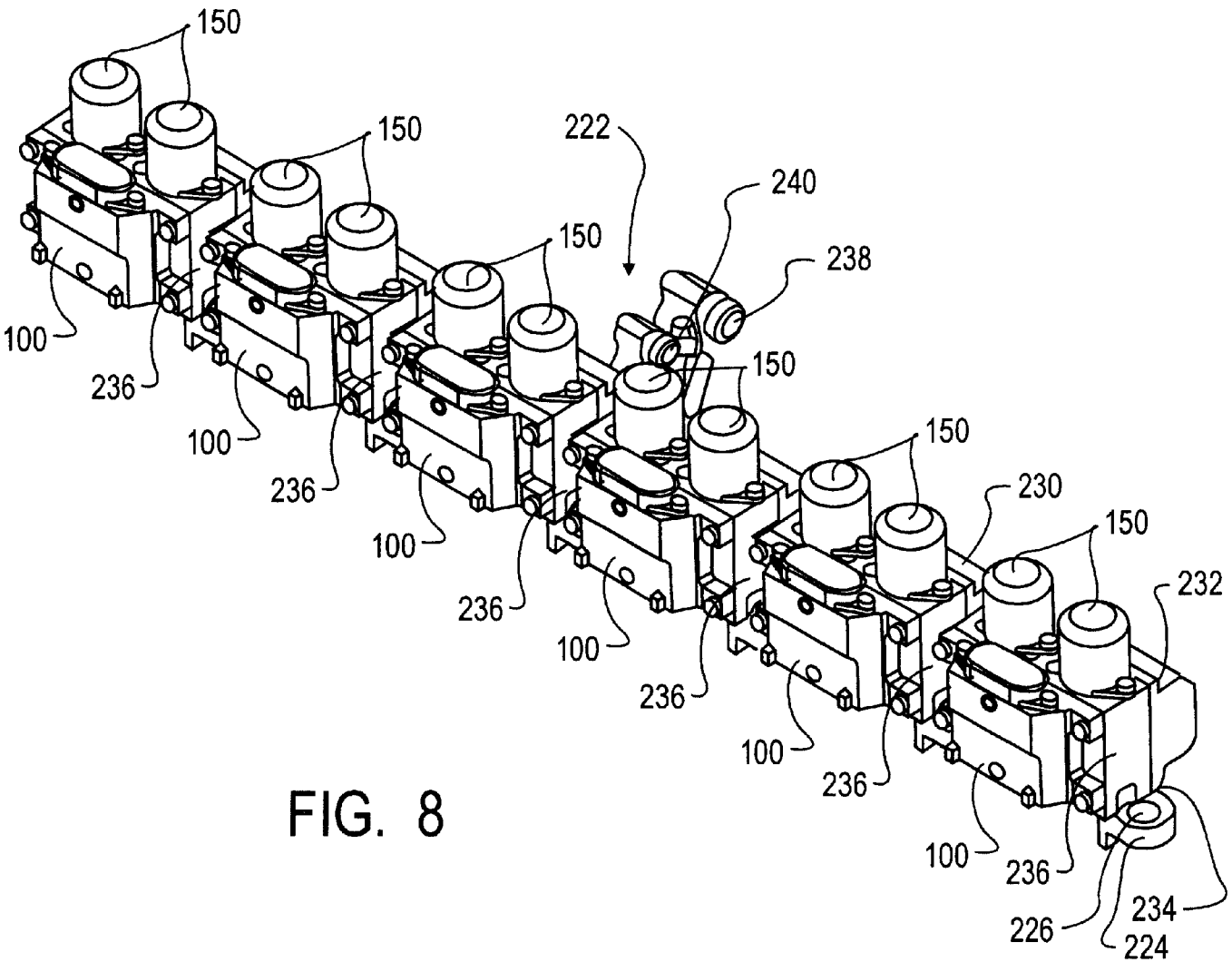
FIG. 8 is a perspective view of six valve actuators of the present invention assembled for mounting on an inline six cylinder engine.

Referring to FIG. 8, a set of six valve actuator modules 100 are mounted in a valve actuator assembly 222. In addition to the six valve actuator modules 100, the valve actuator assembly 222 includes an underlying adaptor plate 224. The adaptor 224 may be mounted directly to the head of an in-line, six cylinder, internal combustion engine. A plurality of bores 226 are defined in the adaptor plate 224 through which bolts can be inserted for threaded engagement with threaded bores defined in the head of the engine. Preferably, there is a bore 226 at either end of the valve actuator assembly 222 and a similar bore 226 defined between each of the valve actuator modules 100.

The valve actuator modules 100 are in turn coupled to the adaptor plate 224 by bolts that extend downward through the bores 228 (see FIG. 10) into threaded engagement with bores defined in the adaptor plate 224. An elongate oil rail assembly 230 preferably extends the full length of the six valve actuator modules 100 and is coupled thereto by bolts 232 that pass through bores defined in rail flanges 234 into threaded engagement with bores defined in the individual valve actuator bodies 236. The oil rail assembly 230 includes a high pressure oil inlet 238 and a low pressure oil inlet 240. The high pressure oil inlet 238 is fluidly coupled to the high pressure rail 136 and the low pressure oil inlet 240 is fluidly coupled to the lubrication pressure rail 134.

Each of the valve actuator modules 100 preferably services both the intake and exhaust valves 112 associated with the cylinder that the valve actuator module is paired with. In the example depicted, the cylinder has one intake and one exhaust valve 112. Accordingly, each valve actuator module 100 includes two sets of the major components of the valve actuator module 100, including the controller 140, needle 142, main piston 144, drive piston 146, and secondary piston 148. The aforementioned sets of components are disposed in a side by side relationship along the longitudinal axis of the valve actuator assembly 222. This is readily apparent in the depiction of FIG. 8 by the side by side relationship of the two controller housings 150 of each valve actuator module 100. It is apparent that a valve actuator module 100 could be constructed to service a cylinder having more than two valves 112. For example, if the cylinder had four valves, a mirror image of the exemplary valve actuator module 100 could be constructed for servicing all the valves of a four valve cylinder. Alternatively, each controller housing 150 could control both intake valves or both exhaust valves through a conventional valve bridge as is known in the art for four valve engine cylinders.

Figure 9:
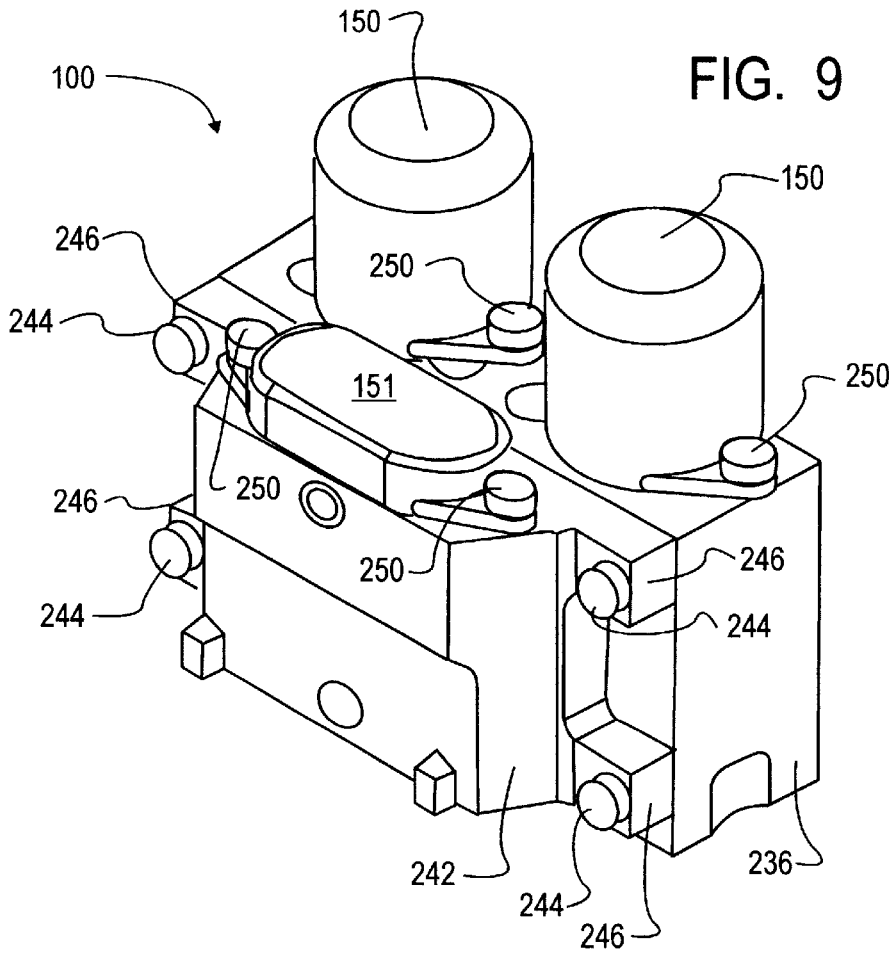
FIG. 9 is a perspective view of a valve actuator of the present invention.
Figure 10:
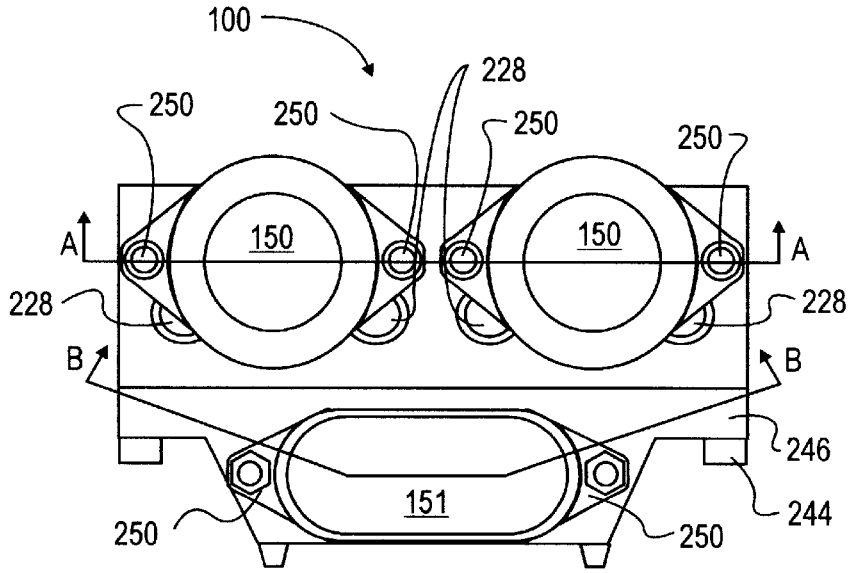
FIG. 10 is a top plan form view of the valve actuator of FIG. 9.
Figure 12:
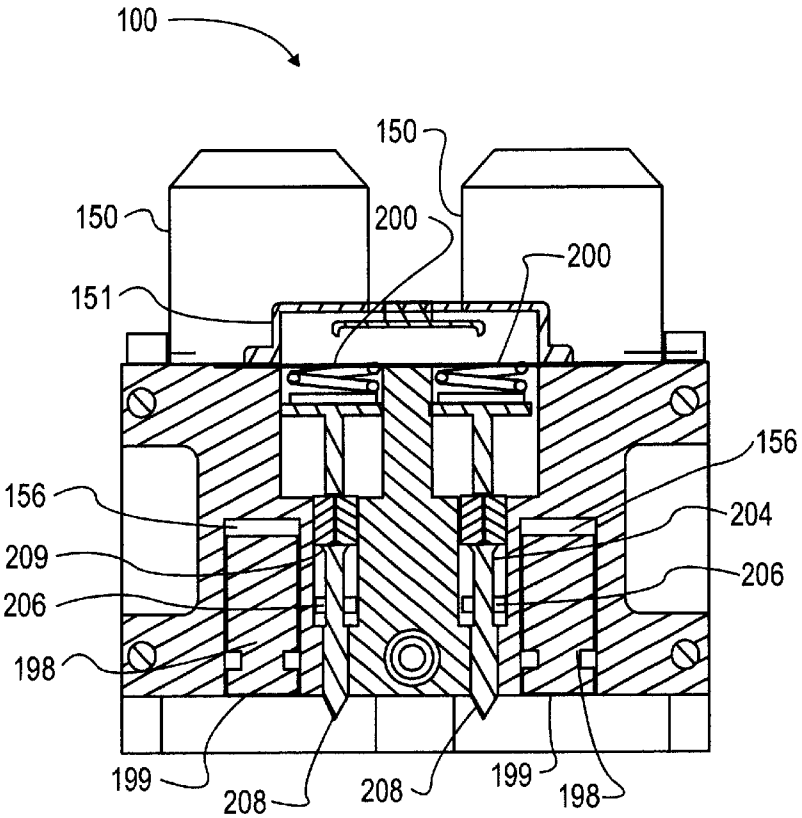
FIG. 12 is a sectional elevational view taken along line B—B of FIG. 10.
Figure 11:
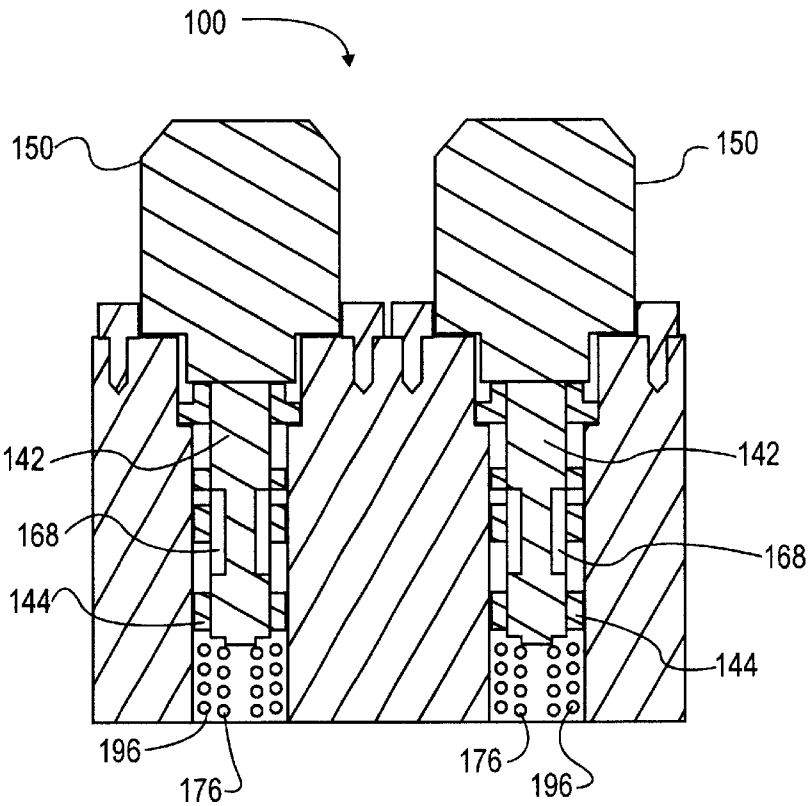
FIG. 11 is a sectional elevational view taken along line A—A of FIG. 10.

Referring to FIGS. 9 and 10, the valve actuator module 100 includes two major housing components: the valve actuator body 236 and the drive piston body 242. The drive piston body 242 is coupled to the valve actuator body 236 by a plurality of bolts 244 inserted through bores 244 defined in flanges 246 and thence into threaded bores 248 defined in the valve actuator body 236. (See also FIGS. 13 and 14.) The controller housing 150 and the needle spring housing 151 are secured to the valve actuator body 236 and the drive piston body 242 respectively by bolts 250.

Figure 14:
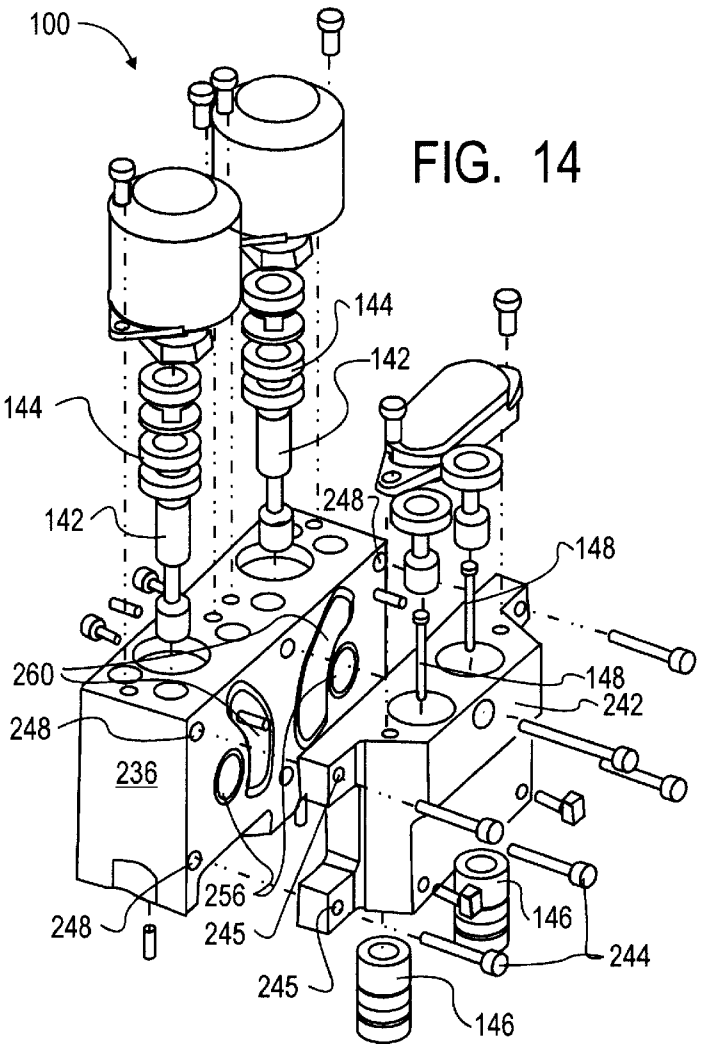
FIG. 14 is a second exploded perspective of the valve actuator of FIG. 9.
Figure 13:
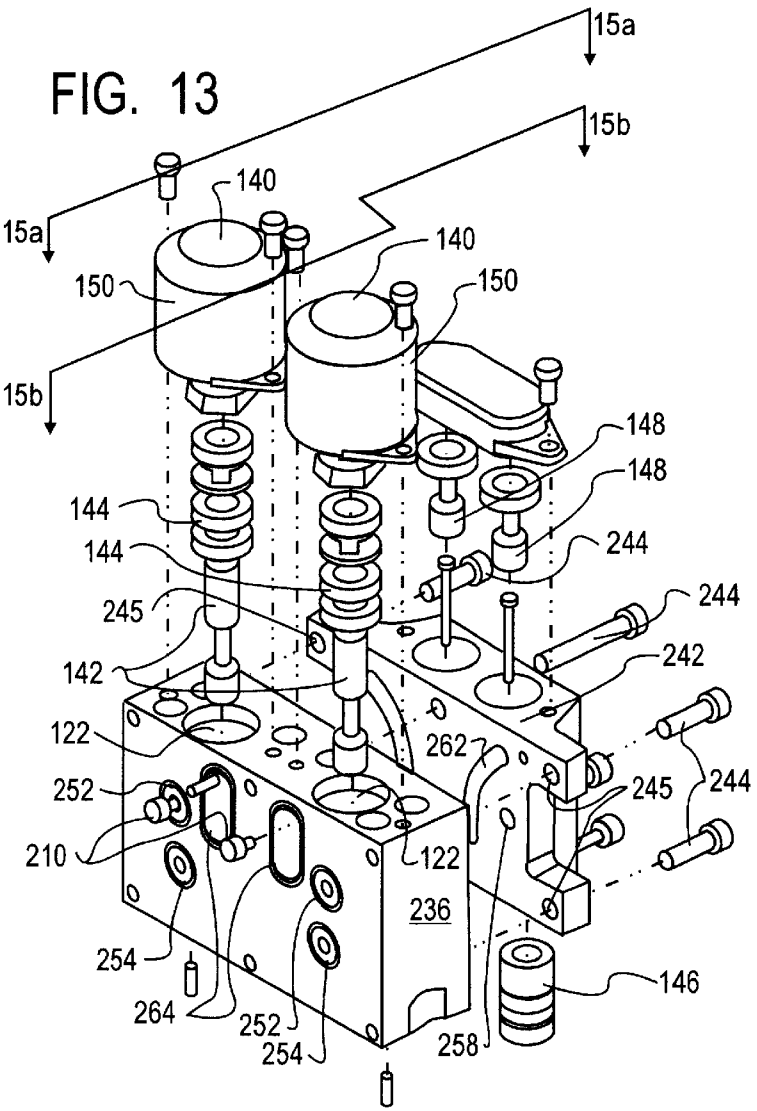
FIG. 13 is a first exploded perspective of the valve actuator of FIG. 9.
Figure 15B:
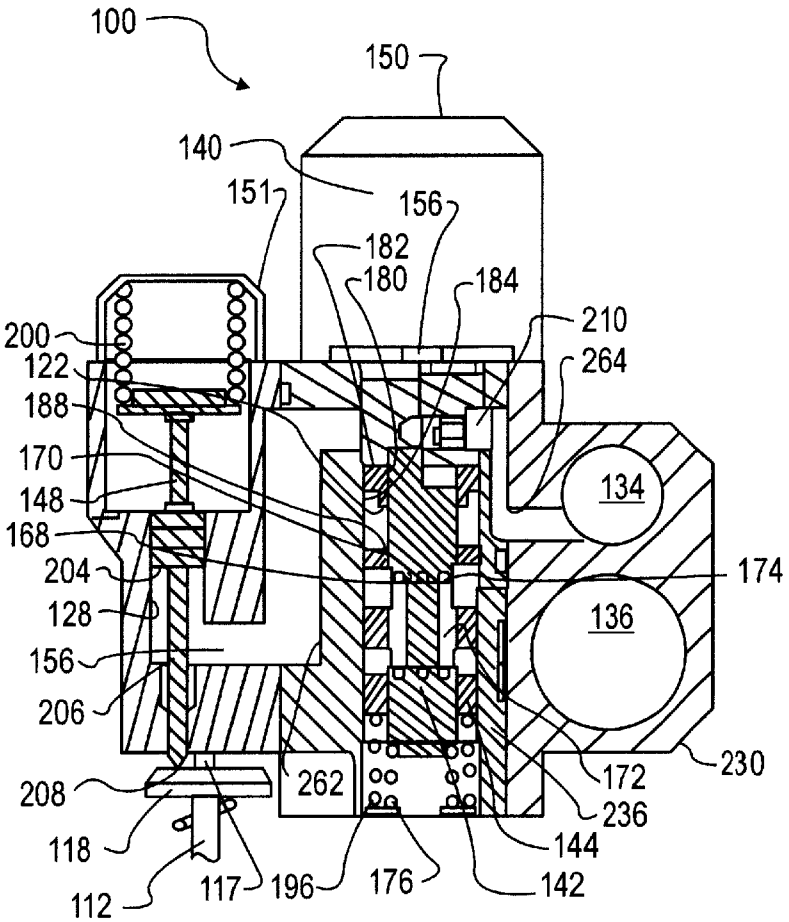
FIG. 15*b* is a mirror image of a sectional elevational view taken along line 15*b*—15*b* of FIG. 13, depicting the engine valve in the closed position.
Figure 15A:
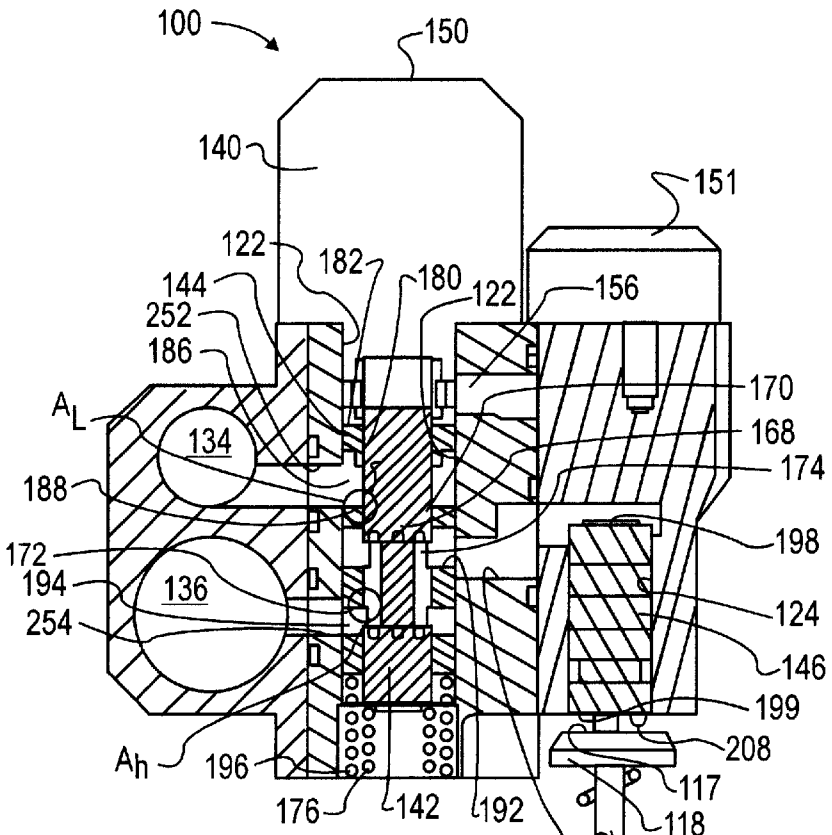
FIG. 15*a* is a sectional elevational view taken along line 15*a*—15*a* of FIG. 13 depicting the engine valve in the closed position.

One of the differences of the embodiment of the valve actuator module 100 of FIGS. 8–18*b* as compared to the embodiment of FIGS. 6–7*d* is that the embodiment of FIGS. 8–18*b* eliminates the need for the lubrication oil line 138 that is used to resupply control chamber 156 in the embodiment of FIGS. 6–7*d*. In the embodiment of FIGS. 8–18*b*, the control chamber 156 is resupplied through a fluid coupling to fluid lubrication rail 134 defined in the oil rail assembly 230 shown in FIG. 15*b*. Referring to FIGS. 13 and 14, a lube fluid pressure inlet 252 and a high pressure fluid inlet 254 are defined in a margin of the valve actuator body 236. The lubrication fluid inlet 252 fluidly couples the lubrication pressure rail 134 to the main piston bore 122 defined in the valve actuator body 236. The high pressure fluid inlet 254 fluidly couples the high pressure rail 136 to the main piston bore 122. A high pressure fluid outlet 256 (FIG. 14) defined in an opposing margin of the valve actuator body 236 fluidly couples the main piston bore 122 to the drive piston 146 by means of the high pressure fluid inlet 258 defined in the drive piston body 242.

An arcuate lubrication pressure fluid outlet 260 defined in the valve actuator body 236 is fluidly coupled to a lubrication pressure fluid inlet 262 (FIG. 13) defined in the drive piston body 242. The arcuate lubrication pressure fluid inlet 262 defines in part the control chamber 156. A second lubrication pressure fluid inlet 264 is defined in the exterior margin of the valve actuator body 236 that is mated with the oil rail assembly 230. In FIG. 13, the second lubrication pressure fluid inlets 234 are shown oblong in shape. The second lubrication pressure fluid inlet 264 acts to fluidly couple the lubrication pressure rail 134 to the control chamber 156. It is the aforementioned fluid communication that serves to replenish the fluid supply in the control chamber 156. Accordingly, the check valve 210 is disposed in the fluid path extending between the second lubrication pressure fluid inlet 264 and the control chamber 156. See FIG. 15*b*.

Figure 16B:
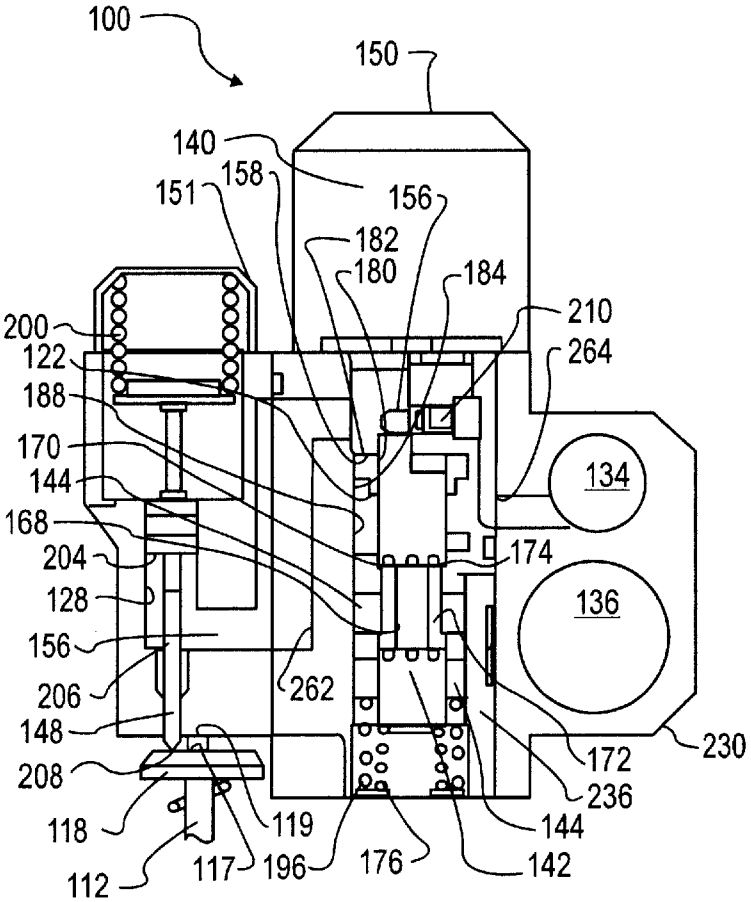
FIG. 16*b* is the sectional view of FIG. 15*b* with the engine valve depicted in the valve opening stroke.
Figure 16A:
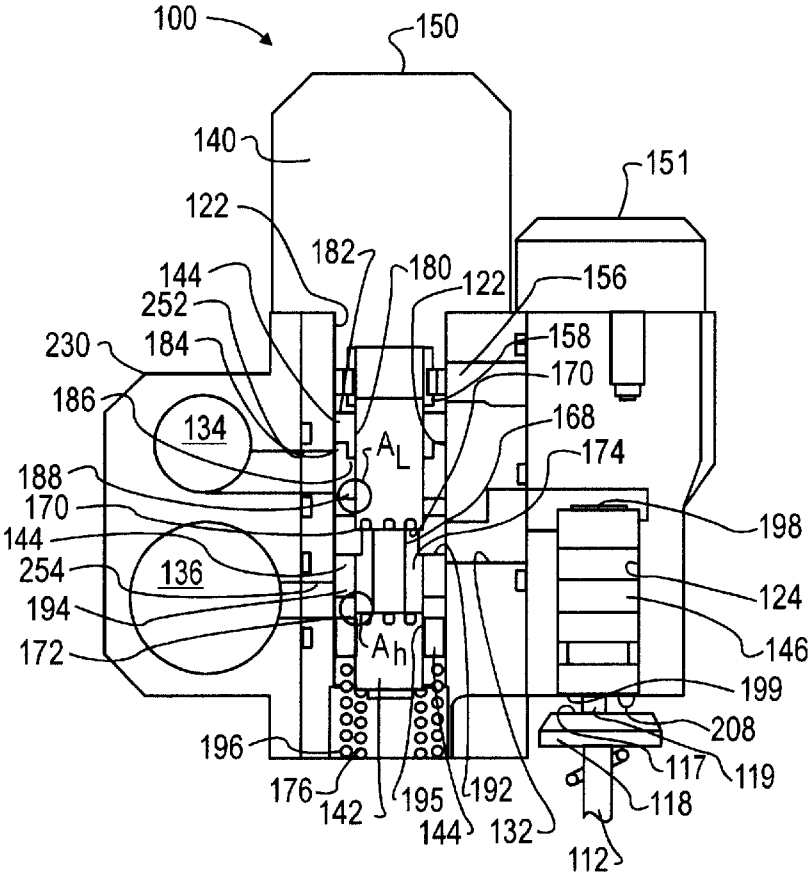
FIG. 16*a* is the sectional view of FIG. 15*a* with the engine valve in the opening stroke.

In order to minimize the height dimension of the valve actuator module 100, the secondary piston 148 is displaced laterally from the drive piston 146 and is not directly coupled to the drive piston 146. The secondary piston 148 and the drive piston 146 translate together (shift between a closed and an open disposition) as a function of the secondary piston 148 being operably coupled to the upper margin 117 of the valve rotator 118 and the drive piston 146 being operably coupled to the upper margin 119 of the valve 112. This side-by-side arrangement effectively couples the translational motion of the secondary piston 148 to the translational motion of the drive piston 146 without any direct contact between the pistons 146, 148. The axes of translation of the secondary piston 148 and the drive piston 146 are substantially parallel and spaced apart Operation of the valve actuator module 100 may be appreciated with reference to FIGS. 16*a*–18*b*. FIGS. 16*a*, 16*b* (like FIGS. 15*a*, 15*b*) depict the engine valve 112 in the closed position just prior to commencement of the downstroke. The engine valve spring 116 maintains the engine valve 112 in the upward closed position. The lower margin 199 of the drive piston 146 is in contact with the upper margin 119 of the valve 112. The tip 208 of the secondary piston 148 bears on the upper margin 117 of the valve rotator 118. Accordingly, the valve spring 116 acts to position both the drive piston 146 and the secondary piston 148 in their fully upward retracted dispositions. The needle 142 and the main piston 144 are also in the fully upward, retracted position. The piston head 182 of the main piston 144 bears on the shoulder 158 of the controller housing 150, the shoulder 158 acting as a stop for the main piston 144. The low pressure throttling area, $A_L$, defined by the interaction of the low pressure shoulder 170 of the spool groove 168 and the low pressure shoulder 188 of the fluid passage 186, is closed (the low pressure shoulders 170, 188 being overlapped), thereby sealing off the lube pressure rail 134 from fluid communication with the drive piston head 198. In this position, high pressure throttle area $A_H$, defined by the interaction between the high pressure shoulder 172 of the groove 168 and the high pressure shoulder 195, is open. When the shoulders 172, 195 are spaced apart (not overlapping), the high pressure throttle area $A_H$ is open, thereby sealing off the high pressure rail 136. Accordingly, the pressure $P_D$ acting on the drive piston 146 is equal to the pressure in the high pressure rail 136. Such pressure presently overcomes the bias exerted by the valve spring 116 to drive the valve 112 downward to the open position. As the secondary piston 148 translates downward, oil in the control chamber 156 is pumped to bear downward on the piston head 182 of the main piston 144. Accordingly, the main piston 144 translates downward slightly lagging the translation of the needle 142.

Figure 17B:
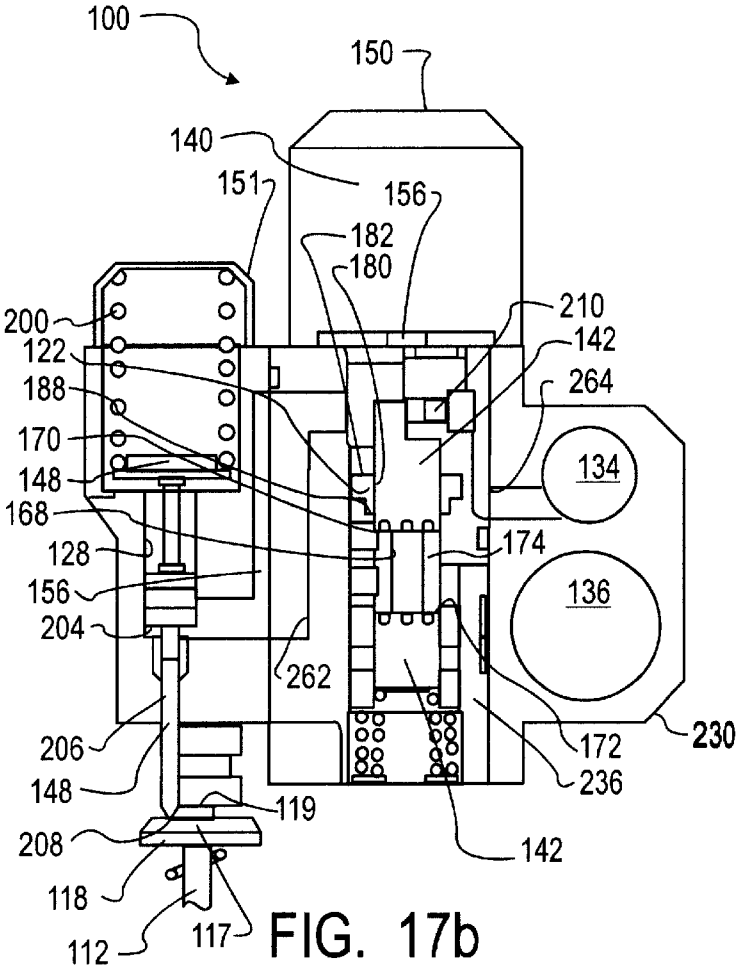
FIG. 17*b* is the sectional view of FIG. 15*b* with the engine valve in the closing stroke.
Figure 17A:
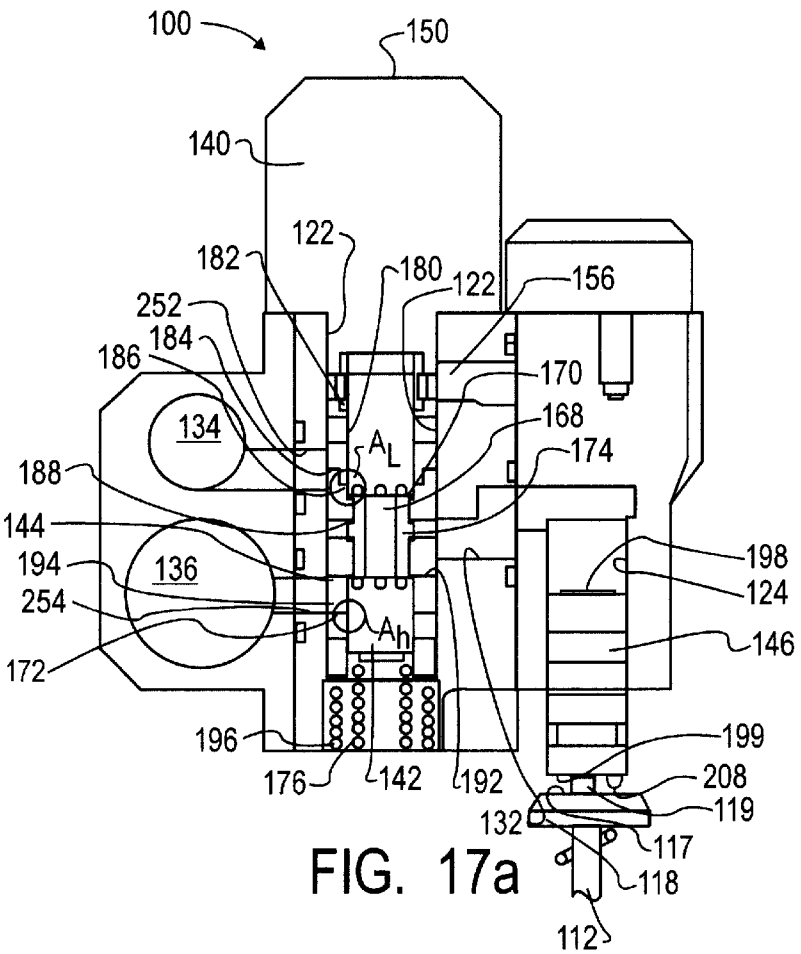
FIG. 17*a* is the sectional view of FIG. 15*a* with the engine valve in the closing stroke.

Referring to FIGS. 17*a*, 17*b*, the engine valve 112 is shown in its fully open disposition. The depiction of FIGS. 17*a*, 17*b* is with the valve 112 fully open, but with the needle 142 and the main piston positioned to cause closing of the valve 112. It is seen that the stroke of the solenoid 160 is approximately one-half the stroke of the drive piston 146 and the engine valve 112 as described above with reference to the embodiment of FIGS. 6–7*d*.

In FIGS. 17*a*, 17*b*, the needle 142 is shown retracted fully upward. High pressure oil from the high pressure rail 136 is sealed off from the drive piston 146. The high pressure throttle area, AH (defined by the overlapping shoulders 172, 195), is closed, sealing the high pressure actuating fluid from the annular fluid passageway 124 and the high pressure oil passage 132. The low pressure throttle area, $A_L$, is open (the shoulders 170, 188 being spaced apart and not in an overlapped relationship) effecting fluid communication between the drive piston head 198 and the low pressure rail 134. The secondary piston 148 is coupled to the rotator 118 by means of the bias exerted by the spring 200.

The closing stroke is commenced by upward retraction of the needle 142 as commanded by the solenoid 160. As the solenoid 160 retracts, the return spring 176 acts upward on the needle 142 to assist in the retraction of the needle 142. The retraction of the needle 142 relative to the main piston 144 opens the low pressure throttle area $A_L$, to the low pressure rail 134. The high pressure oil acting on the drive piston head 198 escapes through the high pressure oil passage 132, the annular fluid passage 174, and the low pressure throttle area, $A_L$, to the low pressure rail 134. Once the high pressure actuating fluid no longer is acting on the drive piston head 198, the valve spring 116 acts to return the engine valve 112 to its closed position. The drive piston 146 is carried upward by the engine valve 112. As the drive piston 146 moves upward, the secondary piston 148 simultaneously is carried upward by the upward moving rotator 118. As the secondary piston 148 moves upward it alters the volume of the control chamber 156. The return spring 196 acting upward on the main piston 144 pumps the fluid in the control chamber 156 to the secondary piston 148. Upward translation of the main piston 144 occurs, slightly lagging the retraction of the needle 142. Such lagging translation ensures that the high pressure throttle area ($A_H$) remains closed during the upward translation of the needle 142 and the main piston 144.

Figure 18B:
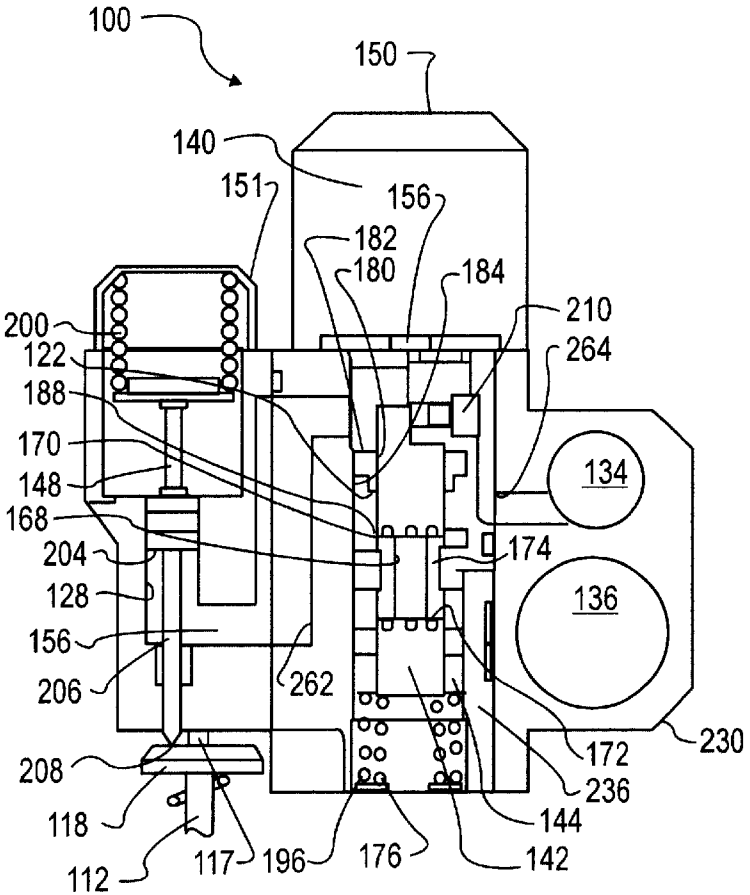
FIG. 18*b* is the sectional view of FIG. 15*b* during lash adjustment.
Figure 18A:
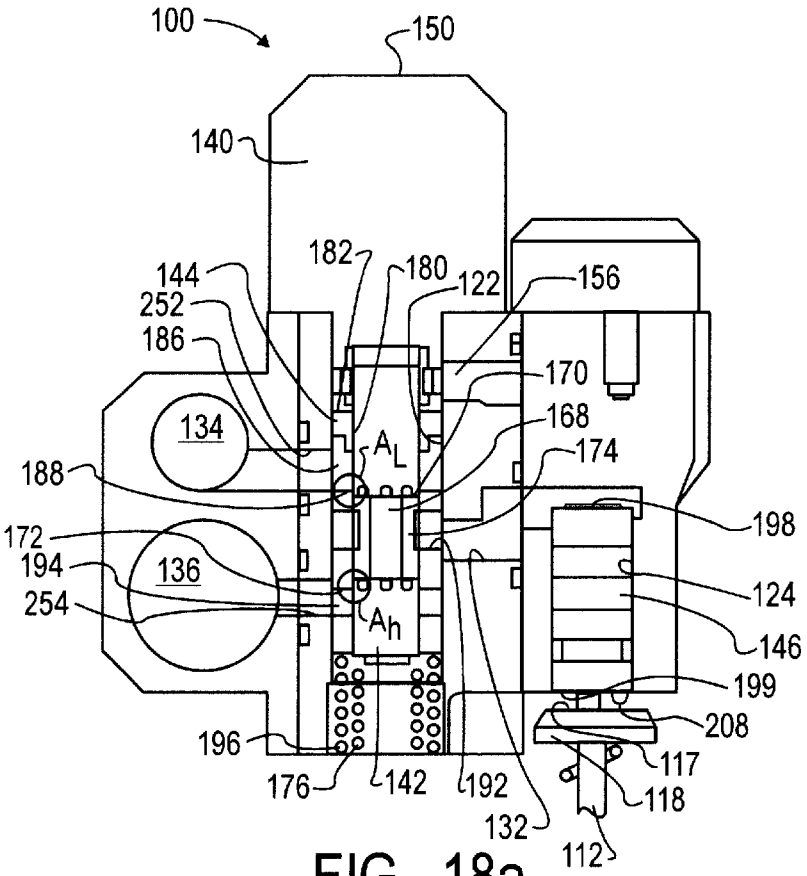
FIG. 18*a* is the sectional view of FIG. 15*a* during valve adjustment.

Lash adjustment occurs as depicted in FIGS. 18*a*, 18*b*. A certain amount of fluid leakage is designed into the control chamber 156. As a result of such leakage, the main piston 144 seats against the shoulder 158, thereby terminating its upward translation slightly ahead of the secondary piston 148 completing its upward translation. The secondary piston 148 continues its upward translation after the seating of the main piston 144. Such upward translation momentarily decreases the pressure in the control chamber 156 to a pressure that is less than the pressure in the low pressure line 138. This momentary decrease of pressure in the control chamber 156 results in the oil pressure in the low pressure line 138 acting on the check valve 210 to compress the check valve spring 212 and to admit a replenishing quantity of oil into the control chamber 156. By always seating the main piston 144 ahead of the secondary piston 148, there is always a brief period of time during which the control chamber 156 may be fully filled without regard to changes in the longitudinal dimension (lash) of the engine valve stem 114.

Variations within the spirit and scope of the invention described are equally comprehended by the foregoing description.

What is claimed is:

1. A hydraulically-assisted engine valve actuator for assisting in the actuation of an engine valve, comprising:

a drive piston operably coupled to the engine valve for actuation of the engine valve and being translatable by a force acting thereon, the force being generated by a fluid under pressure; and a translatable needle valve, the needle valve being in fluid communication with a source of fluid under pressure and further being in fluid communication with the drive piston, the needle valve effecting the metering of the fluid under pressure to generate force on the drive piston, the needle valve being structurally decoupled from the engine valve.

2. The hydraulically-assisted engine valve actuator of claim 1 further including a main piston, the main piston being in fluid communication with the needle valve and being operably fluidly coupled to the engine valve and structurally decoupled from the engine valve.

3. The hydraulically-assisted engine valve actuator of claim 2 wherein the main piston is translatable for effectively magnifying an actuating stroke of the needle valve to effect a magnified stroke of the engine valve.

4. The hydraulically-assisted engine valve actuator of claim 3 wherein a rate of translation of the drive piston is related to a rate of translation of the needle valve to effect a desired opening and closing profile of the engine valve.

5. The hydraulically-assisted engine valve actuator of claim 3 wherein the main piston and the needle valve each have a single dependency for lenient concentricity requirements.

6. The hydraulically-assisted engine valve actuator of claim 1 wherein engine valve lash is automatically accommodated.

7. The hydraulically-assisted engine valve actuator of claim 6 further including a secondary piston, the secondary piston being operably fluidly coupled to the main piston such that a motion of the secondary piston produces a corresponding and opposite related motion of the main piston.

8. The hydraulically-assisted engine valve actuator of claim 7 wherein the secondary piston is operably fluidly coupled to the main piston by means of a control chamber.

9. The hydraulically-assisted engine valve actuator of claim 8 wherein the control chamber is operably coupleable to a source of fluid under pressure, a check valve being disposed between the control chamber and the source of fluid, the check valve opening responsive to a certain pressure in the control chamber to admit filling fluid to the control chamber.

10. The hydraulically-assisted engine valve actuator of claim 9 wherein a selected fluid leakage in the control chamber results in the main piston being seated in retraction prior to the secondary valve being seated in retraction to ensure seating of the main piston on each retraction event.

11. The hydraulically-assisted engine valve actuator of claim 10 wherein seating of the main piston causes a drop in pressure in the control chamber, the drop in pressure acting to cause the opening of the check valve.

12. The hydraulically-assisted engine valve actuator of claim 11 wherein the volume of the control chamber is variable as a function of valve lash.

13. The hydraulically-assisted engine valve actuator of claim 3 wherein the actuating stroke of the needle valve is magnified by a factor related to the ratio of the secondary piston to the main piston.

14. The hydraulically-assisted engine valve actuator of claim 13 wherein the ratio of the secondary piston to the main piston is selectively variable between greater than 1:1 and less than 6:1.

15. The hydraulically-assisted engine valve actuator of claim 1 wherein a controller is operably coupled to the needle valve, the controller including a needle positioning mechanism.

16. The hydraulically-assisted engine valve actuator of claim 15 wherein the needle positioning mechanism is a solenoid.

17. A hydraulically-assisted engine valve actuator for assisting in the actuation of an engine valve, comprising:

a servo piston being operably coupled to the engine valve;

a translatable pilot valve being in fluid communication with the servo piston and a power piston and being operably coupled to and controlled by a pilot valve positioning system, the pilot valve positioning system controlling a translational stroke of the pilot valve to meter hydraulic fluid under pressure to and from the servo piston; and a stroke magnifier for magnifying a stroke of the pilot valve positioning system.

18. The hydraulically-assisted engine valve actuator of claim 17 wherein the stroke magnifier includes a main piston, the main piston being in fluid communication with the pilot valve and being operably fluidly coupled to the engine valve and structurally decoupled from the engine valve.

19. The hydraulically-assisted engine valve actuator of claim 18 wherein the main piston is translatable for effectively magnifying an actuating stroke of the pilot valve to effect a magnified stroke of the engine valve.

20. The hydraulically-assisted engine valve actuator of claim 19 wherein a rate of translation of the servo piston is related to a rate of translation of the pilot valve to effect a desired opening and closing profile of the engine valve.

21. The hydraulically-assisted engine valve actuator of claim 20 wherein the main piston and the pilot valve have a single dependency for lenient concentricity requirements.

22. The hydraulically-assisted engine valve actuator of claim 21 wherein engine valve lash is automatically accommodated.

23. The hydraulically-assisted engine valve actuator of claim 22 the stroke magnifier further including a secondary piston, the secondary piston being operably fluidly coupled to the main piston such that a motion of the secondary piston produces a corresponding and opposite motion of the main piston.

24. The hydraulically-assisted engine valve actuator of claim 23 wherein the secondary piston is operably fluidly coupled to the main piston by means of a control chamber.

25. The hydraulically-assisted engine valve actuator of claim 24 wherein the control chamber is operably coupleable to a source of fluid under pressure, a check valve being disposed between the control chamber and the source of fluid, the check valve opening responsive to a certain pressure in the control chamber to admit filling fluid to the control chamber.

26. The hydraulically-assisted engine valve actuator of claim 17 wherein the pilot valve positioning system includes a solenoid.

27. The hydraulically-assisted engine valve actuator of claim 26 wherein the solenoid has a linear stroke of less than substantially 6mm.

28. The hydraulically-assisted engine valve actuator of claim 25 wherein a selected fluid leakage in the control chamber results in the main piston being seated during retraction prior to the secondary valve being seated during retraction to ensure seating of the main piston on each retraction event.

29. The hydraulically-assisted engine valve actuator of claim 28 wherein seating of the main piston causes a drop in pressure in the control chamber, the drop in pressure acting to cause the opening of the check valve.

30. The hydraulically-assisted engine valve actuator of claim 29 wherein the volume of the control chamber is variable as a function of engine valve lash.

31. The hydraulically-assisted engine valve actuator of claim 30 wherein the actuating stroke of the needle valve is magnified by a factor related to the ratio of the secondary piston to the main piston.

32. The hydraulically-assisted engine valve actuator of claim 31 wherein the ratio of the secondary piston to the main piston is selectively variable between greater than 1:1 and less than 6:1.

33. A method of actuation of an engine valve, comprising the steps of:

operably coupling a servo piston to the engine valve;

translating a pilot valve responsive to control inputs by a pilot valve positioning system for metering hydraulic fluid by means of translation of the pilot valve relative to the servo piston to affect the servo piston and a main piston;

magnifying a translational stroke of the pilot valve positioning system; and translating the engine valve by means of translating the servo piston by means of a force exerted on the servo piston by the hydraulic fluid under pressure, the hydraulic fluid under pressure causing the servo piston to closely follow the translation of the pilot valve to effect a desired profile of translational opening and closing motion of the engine valve, a stroke of the engine valve being substantially equal to the magnified stroke of the pilot valve positioning system.

34. The method of claim 33 further including the step of accommodating engine valve lash.

35. The method of claim 34 further including the step of magnifying the stroke of the pilot valve positioning system by means of a main piston.

36. The method of claim 35 of ensuring the seating of the main piston on each main piston retraction event.

37. A valve actuator assembly for disposition on a valve head of a bank of engine cylinders, the bank of cylinders including at least two cylinders, each cylinder having at least two valves, each valve being cylclable between an open disposition and a closed disposition, comprising:

a plurality of valve actuator modules operably coupled to the valve head, a valve actuator module being paired to each cylinder in the bank of cylinders and actuating each of the valves of the cylinder; and an oil rail assembly being operably coupled to each of the plurality of valve actuator modules, the oil rail assembly conveying a low pressure actuating fluid and a high pressure actuating fluid, the low pressure actuating fluid and the high pressure actuating fluid being in communication with each of the plurality of valve actuator modules.

38. The valve actuator assembly of claim 37 further including an adapter plate, each of the plurality of valve actuator modules being operably coupled to the adapter plate, the adapter plate being operably couplable to the valve head.

39. The valve actuator assembly of claim 37 wherein the low pressure actuating fluid is in communication with a control chamber, the control chamber being replenishable by low pressure actuating fluid at each valve opening and closing cycle.

40. The valve actuator assembly of claim 39 wherein the high pressure actuating fluid is in communication with a drive piston, the drive piston being operably couplable to a valve, the high pressure actuating fluid acting on the drive piston to open the valve.

41. The valve actuator assembly of claim 40 further including a secondary piston defining in part the volume of the control chamber.

42. The valve actuator assembly of claim 41 wherein the secondary piston is spaced apart from the drive piston and being shiftable along an axis that is substantially parallel to an axis of translation of the drive piston.

43. The valve actuator assembly of claim 42 wherein the secondary piston is operably coupled to a valve rotator, the valve rotator acting to shift the secondary piston during the cycle of the valve.

44. The valve actuator assembly of claim 43 further including a needle, the needle being actuatable by a controller and being disposed concentrically in a main piston, the main piston acting to magnify a stroke of the needle as the stroke of the needle affects the stroke of the valve.

45. The valve actuator assembly of claim 44 wherein the main piston is in communication with the control chamber and is shiftable by a force generated by a fluid in the control chamber acting on the main piston.

46. The valve actuator assembly of claim 45 wherein the needle and the main piston act cooperatively to port the high pressure actuating fluid to and from the drive piston for actuation of the valve operably coupled to the drive piston.

47. The valve actuator assembly of claim 39 wherein replenishing the actuating fluid in the control chamber acts to accommodate valve lash.

48. A valve actuator module for disposition on an engine cylinder, the cylinder having at least two valves, each valve being strokable between an open disposition and a closed disposition, comprising:

a drive piston operably coupled to the valve and being in selective communication with a low pressure actuating fluid and a high pressure actuating fluid, the high pressure actuating fluid acting on the drive piston to stroke the valve open; and a magnifier being in fluid communication with the drive piston the magnifier acting to magnify an actuating stroke commanded by a controller to proportionally increase the valve stroke.

49. The valve actuator assembly of claim 48 wherein the low pressure actuating fluid is in communication with a control chamber, the control chamber being replenishable by low pressure actuating fluid at each valve closing stroke.

50. The valve actuator assembly of claim 49 further including a secondary piston defining in part a volume of a control chamber.

51. The valve actuator module of claim 50 wherein the secondary piston is spaced apart from the drive piston and being shiftable along an axis that is substantially parallel to an axis of translation of the drive piston.

52. The valve actuator module of claim 51 wherein the secondary piston is operably coupled to a valve rotator, the valve rotator acting to shift the secondary piston during the closing stroke of the valve.

53. The valve actuator module of claim 52 further including a needle, the needle being actuatable by the controller and being disposed concentrically in a main piston, the main piston comprising in part the magnifier and acting to magnify a stroke of the needle as the stroke of the needle affects the stroke of the valve.

54. The valve actuator module of claim 53 wherein the main piston is in communication with the control chamber and is shiftable by a force generated by a fluid in the control chamber acting on the main piston.

55. The valve actuator module of claim 54 wherein the needle and the main piston act cooperatively to port the high pressure actuating fluid to and from the drive piston for actuation of the valve operably coupled to the drive piston.

56. The valve actuator module of claim 49 wherein replenishing the actuating fluid in the control chamber acts in part to accommodate valve lash.

57. The valve actuator module of claim 49 wherein a volume of the control chamber is automatically variable to accommodate valve lash.

* * * * *